US008944870B1

(12) United States Patent
Ochiai et al.

(10) Patent No.: US 8,944,870 B1
(45) Date of Patent: Feb. 3, 2015

(54) OUTBOARD MOTOR

(71) Applicant: Yamaha Hatsudoki Kabushiki Kaisha, Iwata (JP)

(72) Inventors: Katsumi Ochiai, Shizuoka (JP); Koichi Nakayama, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 135 days.

(21) Appl. No.: 13/903,146

(22) Filed: May 28, 2013

Related U.S. Application Data

(63) Continuation-in-part of application No. 13/081,532, filed on Apr. 7, 2011, now Pat. No. 8,469,754, and a continuation-in-part of application No. 13/196,972, filed on Aug. 3, 2011, now Pat. No. 8,585,452, and a continuation-in-part of application No. 13/293,152, filed on Nov. 10, 2011, now Pat. No. 8,795,013, and a continuation-in-part of application No. 13/651,604, filed on Oct. 15, 2012, now Pat. No. 8,764,501.

(51) Int. Cl.
*B63H 21/32* (2006.01)
*B63H 20/24* (2006.01)

(52) U.S. Cl.
CPC ..... *B63H 20/24* (2013.01)
USPC ..... 440/89 H; 440/89 R; 60/323

(58) Field of Classification Search
USPC ..... 440/89 F, 89 H, 89 R; 60/323
See application file for complete search history.

(56) References Cited

U.S. PATENT DOCUMENTS

| | | | | |
|---|---|---|---|---|
| 5,554,057 | A | 9/1996 | Abe et al. | |
| 7,698,889 | B1 | 4/2010 | Burk et al. | |
| 8,469,754 | B1 * | 6/2013 | Maekawa et al. | 440/89 H |
| 8,585,452 | B1 * | 11/2013 | Maekawa et al. | 440/89 H |
| 8,764,501 | B1 * | 7/2014 | Maekawa et al. | 440/89 H |
| 8,795,013 | B1 * | 8/2014 | Nakayama et al. | 440/89 H |
| 2009/0215341 | A1 | 8/2009 | Ochiai | |

OTHER PUBLICATIONS

Maekawa et al., "Outboard Motor"; U.S. Appl. No. 13/081,532, filed Apr. 7, 2011.
Maekawa et al., "Marine Propulsion Device"; U.S. Appl. No. 13/196,972, filed Aug. 3, 2011.
Nakayama et al., "Outboard Motor", U.S. Appl. No. 13/293,152, filed Nov. 10, 2011.
Maekawa et al., "Outboard Motor"; U.S. Appl. No. 13/651,604, filed Oct. 15, 2012.

* cited by examiner

*Primary Examiner* — Lars A Olson
(74) *Attorney, Agent, or Firm* — Keating & Bennett, LLP

(57) ABSTRACT

An exhaust passage of an outboard motor includes a first exhaust passage and a second exhaust passage. The second exhaust passage is positioned on a downstream side of the first exhaust passage. A first honeycomb structure is disposed inside the first exhaust passage. A second honeycomb structure is disposed inside the second exhaust passage. The first exhaust passage and the second exhaust passage are separate and independent members that are connected to each other. A first opening into which the first honeycomb structure can be inserted is provided at an end portion of the first exhaust passage. A second opening into which the second honeycomb structure can be inserted is provided at an end portion of the second exhaust passage.

25 Claims, 20 Drawing Sheets

OUTBOARD MOTOR

BACKGROUND OF THE INVENTION

1. Field of the Invention

The present invention relates to an outboard motor.

2. Description of the Related Art

Outboard motors provided with a catalyst to clean the exhaust from the engine are known. For example, in the outboard motor disclosed in U.S. Pat. No. 5,554,057, a catalyst is disposed below the engine. It is disclosed that water is kept out of the catalyst by disposing a heat accumulator downstream of the catalyst.

In U.S. Pat. No. 7,698,889, which relates to a stern drive rather than an outboard motor, it is disclosed that water is kept out of the catalyst by disposing a non-catalytic porous member downstream of the catalyst.

In the outboard motor disclosed in U.S. Patent Application Publication 2009/0215341, an exhaust pipe extends upward from a cylinder, passes above the cylinder, and extends downward at the opposite side of the cylinder. A moisture capture member is disposed in a portion of the exhaust pipe. The portion is positioned above the cylinder.

A water capture member and catalyst member are disposed in the same exhaust passage, whereby water exposure of an oxygen sensor disposed downstream from a catalyst member can be minimized. Such a structure is manufactured by, e.g., press-fitting two honeycomb structures into the same exhaust passage. In this case, the honeycomb structure on the inner side is inserted into the exhaust passage, after which the honeycomb structure on the outer side is inserted into the exhaust passage. Therefore, it is possible that the surface roughness on the inner surface of the exhaust passage will be reduced by friction between the exhaust passage and the previously press-fitted honeycomb structure. In this case, the holding function of the exhaust passage in relation to the honeycomb structure on the outer side is reduced.

SUMMARY OF THE INVENTION

Preferred embodiments of the present invention provide an outboard motor that can improve the function of holding the honeycomb structure in the exhaust passage.

An outboard according to a preferred embodiment of the present invention includes an engine, a propeller shaft, a plurality of exhaust ports, an exhaust passage, a first honeycomb structure, and a second honeycomb structure. The engine includes a plurality of vertically aligned cylinders. The propeller shaft is driven by a drive force from the engine. The plurality of exhaust ports are connected to the plurality of cylinders. The exhaust passage is connected to the plurality of exhaust ports and discharges exhaust to the exterior of the engine. The exhaust passage includes a first exhaust passage and a second exhaust passage. The second exhaust passage is positioned on a downstream side of the first exhaust passage, i.e., downstream in a direction in which the exhaust flows through the exhaust passage from the first exhaust passage. The first honeycomb structure is disposed inside the first exhaust passage. The second honeycomb structure is disposed inside the second exhaust passage. The first exhaust passage and the second exhaust passage are separate and independent members that are connected to each other. A first opening into which the first honeycomb structure can be inserted is provided at an end portion of the first exhaust passage. A second opening into which the second honeycomb structure can be inserted is provided at an end portion of the second exhaust passage.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
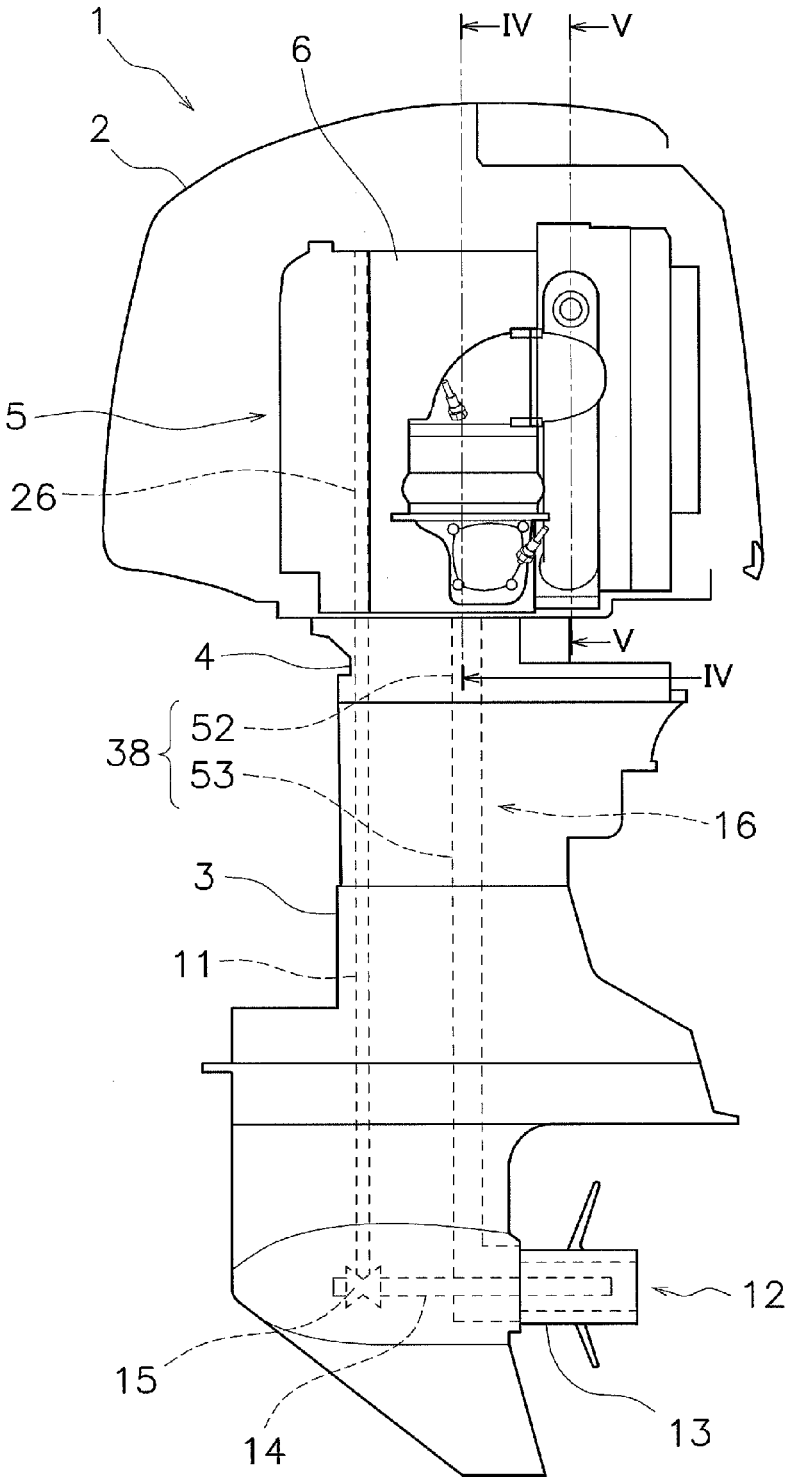
FIG. 1 is a side view of an outboard motor according to a first preferred embodiment of the present invention.
Figure 2:
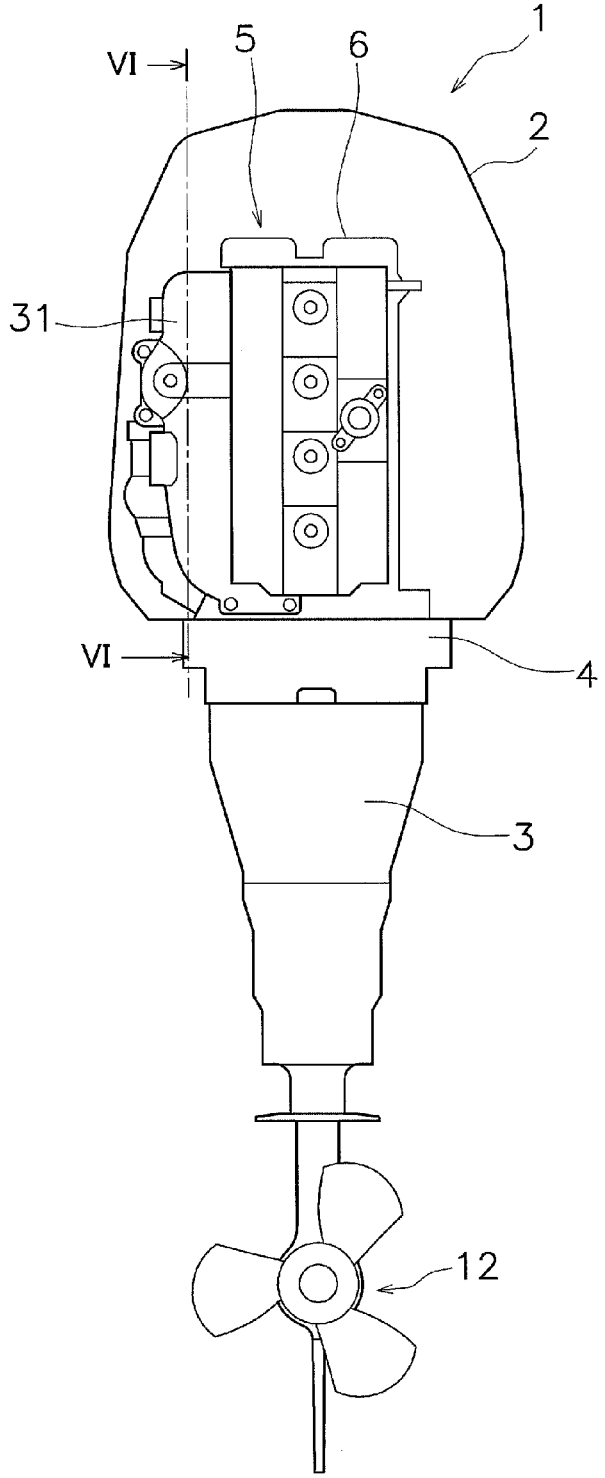
FIG. 2 is a rear view of an outboard motor according to the first preferred embodiment of the present invention.

FIG. 1 is a side view showing an outboard motor 1 according to the first preferred embodiment of the present invention. FIG. 2 is a rear view showing the outboard motor 1 according to the first preferred embodiment of the present invention. As shown in FIGS. 1 and 2, the outboard motor 1 according to the present preferred embodiment includes an upper casing 2, a lower casing 3, an exhaust guide section 4, and an engine unit 5. For ease of understanding, the upper casing 2 is shown in cross section in FIGS. 1 and 2. The upper casing 2, the lower casing 3, and the engine unit 5 are fixed to the exhaust guide section 4.

The engine unit 5 is disposed inside the upper casing 2. In other words, the upper casing 2 is an engine cover arranged to cover the engine unit 5. A drive shaft 11 is disposed inside the lower casing 3, as shown in FIG. 1. The drive shaft 11 is disposed in the vertical direction inside the lower casing 3. The drive shaft 11 is fixed to a crankshaft 26 of an engine 6. A propeller 12 is disposed on the bottom portion of the lower casing 3. The propeller 12 is disposed below the engine 6. The propeller 12 includes a propeller boss 13. A propeller shaft 14 is disposed inside the propeller boss 13. The propeller shaft 14 is disposed in an anteroposterior direction, i.e., backward and forward direction. The propeller shaft 14 is linked to the bottom portion of the drive shaft 11 via a bevel gear 15.

In the outboard motor 1, the drive force generated by the engine 6 is transmitted to the propeller 12 via the drive shaft 11 and the propeller shaft 14. Thus, the propeller 12 is rotated forward or in reverse. As a result, a propulsion force will be generated to cause the vessel equipped with the outboard motor 1 to move forward or backward.

The outboard motor 1 also includes an exhaust passage 16. The exhaust passage 16 extends from the engine 6 through the exhaust guide section 4 and the lower casing 3 to the propeller boss 13 of the propeller 12. The exhaust discharged from the engine 6 is discharged into the water from the exhaust passage 16 through the propeller boss 13. The construction of the exhaust passage 16 will be described in detail below.

Figure 3:
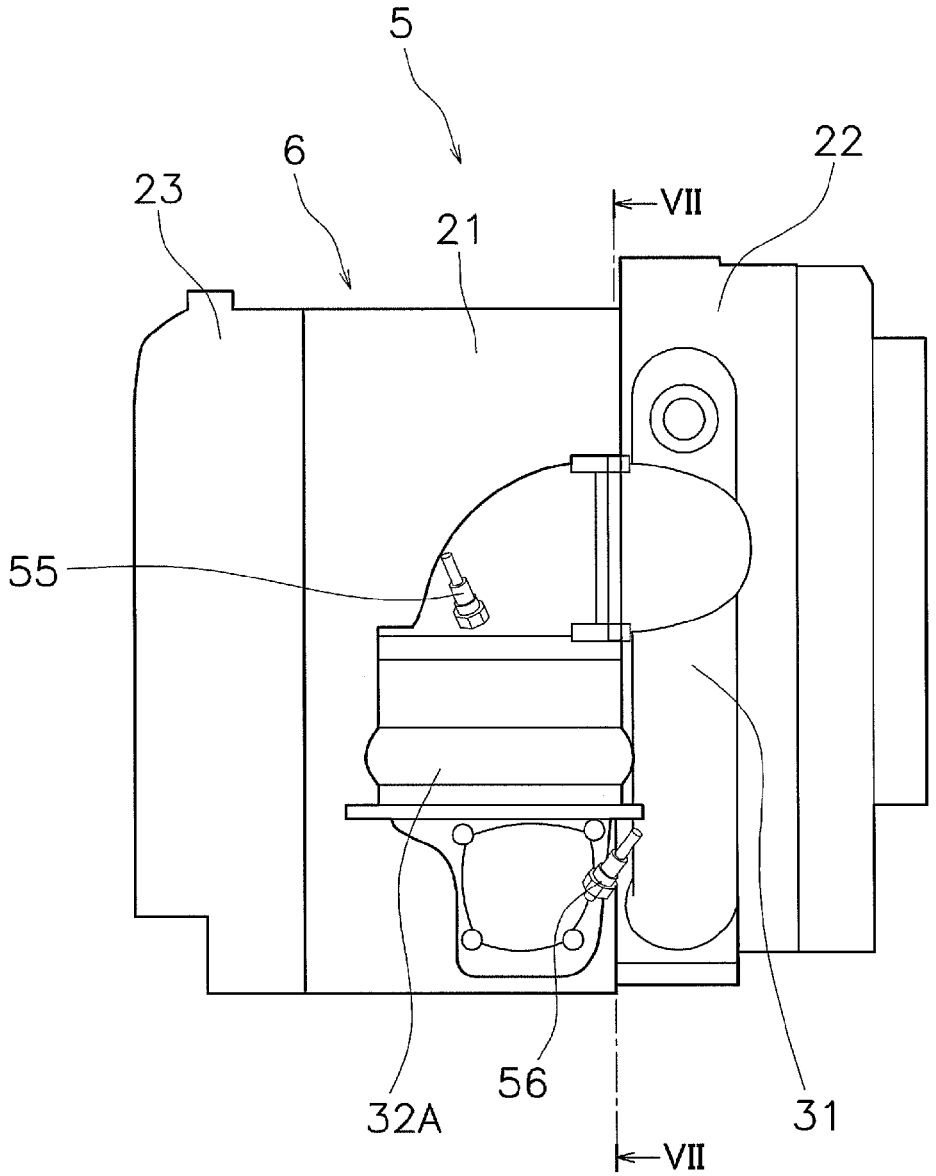
FIG. 3 is a side view of an engine unit mounted in an outboard motor according to the first preferred embodiment of the present invention.

FIG. 3 is a side view of the engine unit 5. The engine unit 5 includes an engine 6, an exhaust manifold 31, and a catalyst unit 32A, as shown in FIG. 3.

Figure 4:
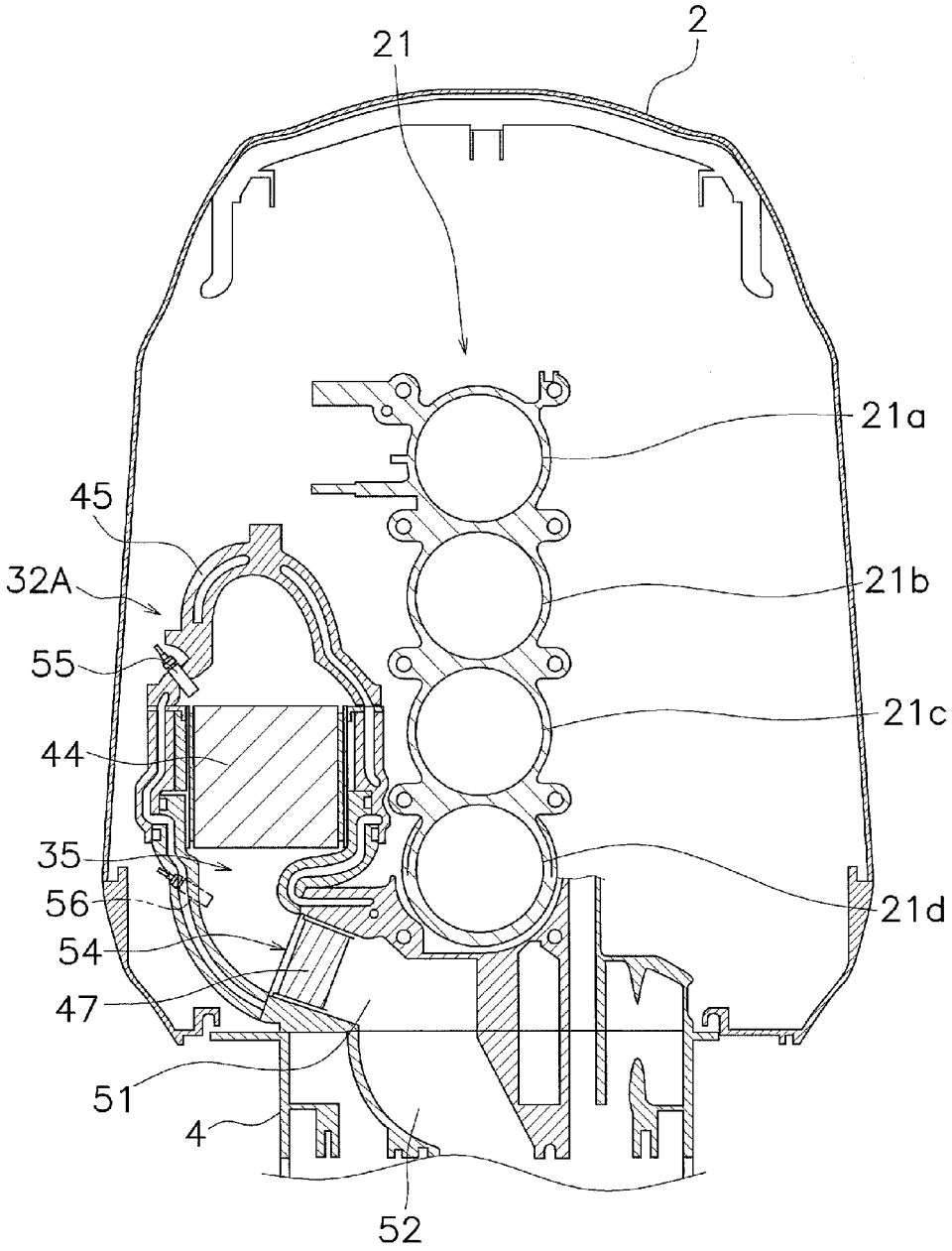
FIG. 4 is a cross-sectional view along line IV-IV in FIG. 1.

The engine 6 includes a cylinder block 21, a cylinder head 22, and a crankcase 23. The cylinder block 21 is disposed above the exhaust guide section 4 and fixed to the exhaust guide section 4. FIG. 4 is a cross-sectional view along line IV-IV of the outboard motor 1 in FIG. 1. As shown in FIG. 4, the cylinder block 21 preferably includes four cylinders 21*a* to 21*d*. The four cylinders 21*a* to 21*d* are disposed in a line in a vertical direction.

Figure 5:
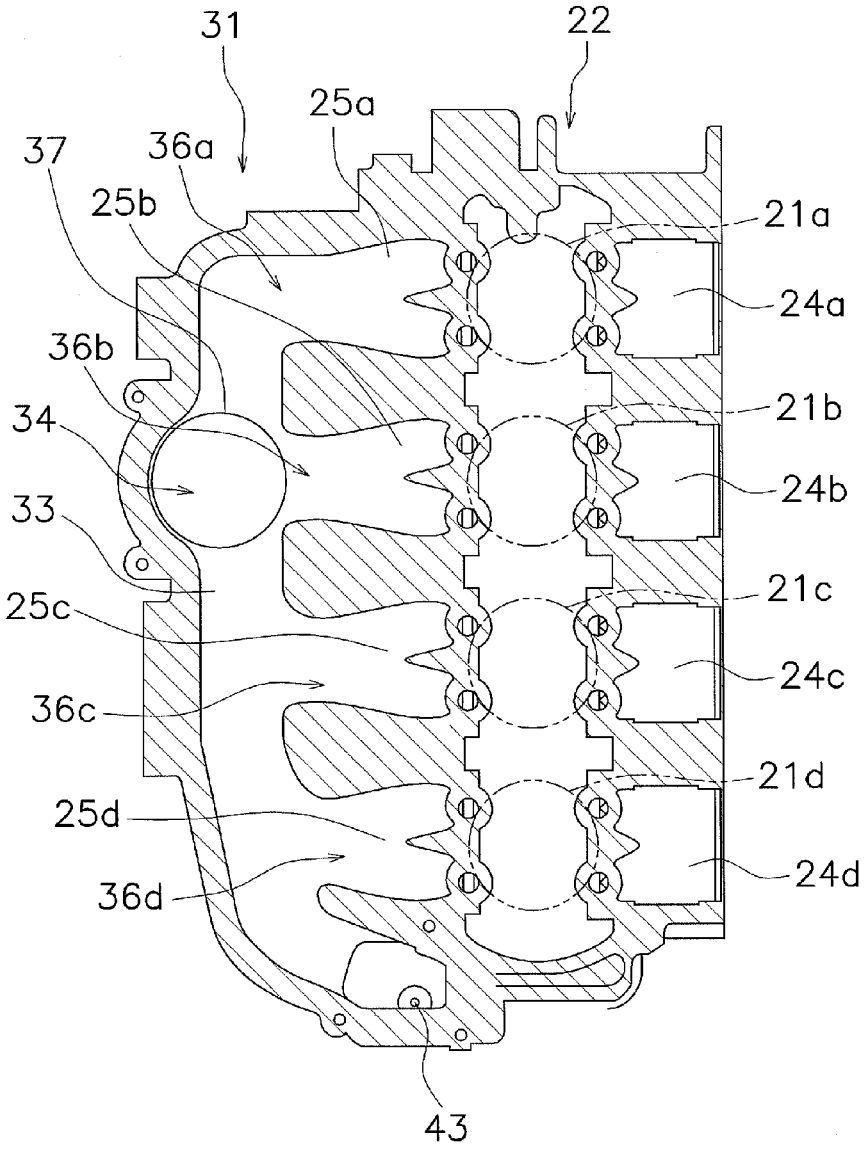
FIG. 5 is a cross-sectional view along line V-V in FIG. 1.

As shown in FIG. 3, the cylinder head 22 is disposed behind the cylinder block 21. FIG. 5 is a cross-sectional view of the outboard motor 1 along line V-V in FIG. 1. As shown in FIG. 5, intake ports 24*a* to 24*d* and exhaust ports 25*a* to 25*d* are disposed inside the cylinder head 22. The intake ports 24*a* to 24*d* and the exhaust ports 25*a* to 25*d* are connected to the cylinders 21*a* to 21*d*, respectively. The intake ports 24*a* to 24*d* are connected to a fuel supply system not shown in the drawings. The exhaust ports 25*a* to 25*d* extend in a lateral direction and are connected to a first passage 33 of an exhaust manifold 31, discussed below.

The crankcase 23 is disposed at the front of the cylinder block 21, as shown in FIG. 3. The crankshaft 26 (see FIG. 1) is disposed inside the crankcase 23. The crankshaft 26 extends in a vertical direction. The top end portion of the above-described driveshaft 11 is linked to the bottom end portion of the crankshaft 26. The movement of pistons (not shown) disposed inside the cylinders 21*a* to 21*d* is transmitted to the driveshaft 11 via the crankshaft 26.

The exhaust manifold 31 is disposed on the side of the cylinder head 22, as shown in FIG. 3. The exhaust manifold 31 is integrally formed with the cylinder head 22. The exhaust manifold 31 directs exhaust from the exhaust port 25*a* downward from above, directs exhaust from the exhaust port 25*b* in the horizontal direction, and directs exhaust from the exhaust port 25*c* and the exhaust port 25*d* upward from below.

Figure 6:
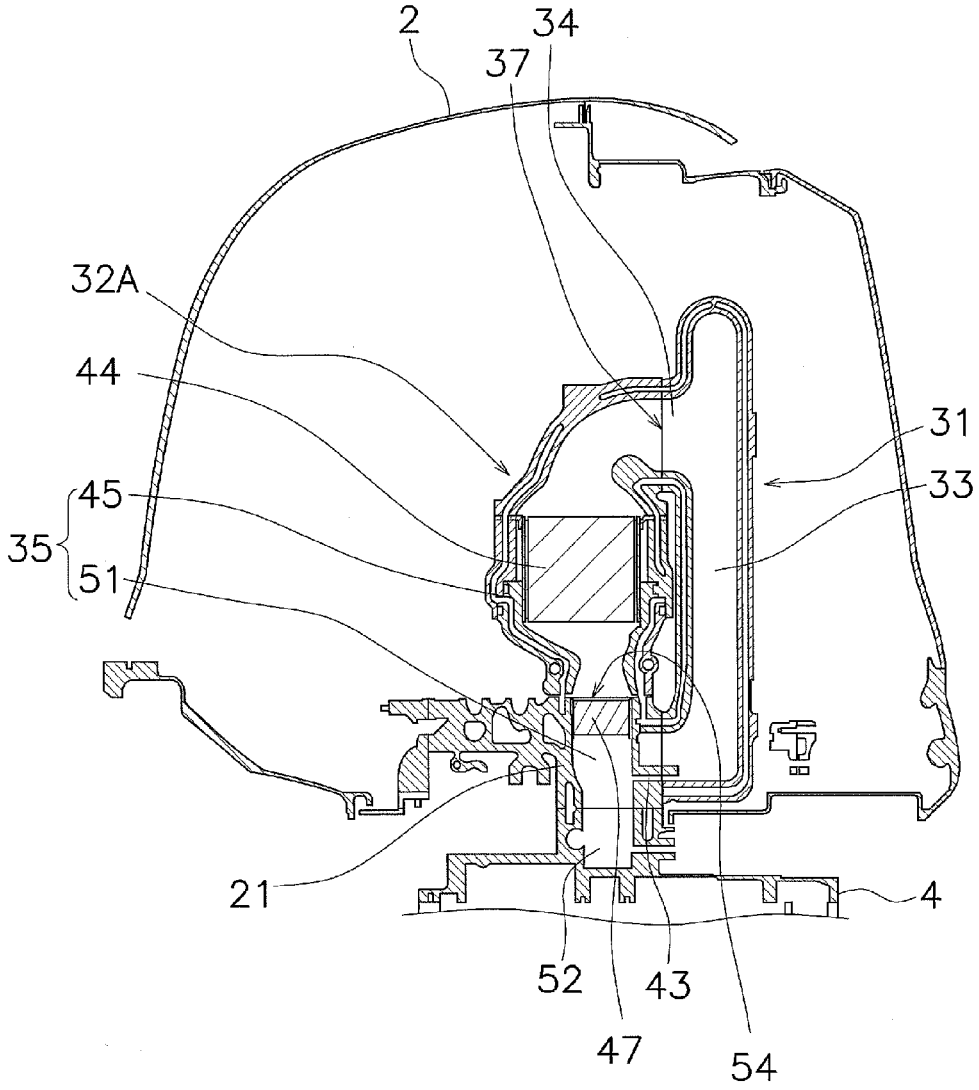
FIG. 6 is a cross-sectional view along line VI-VI in FIG. 2.
Figure 7:
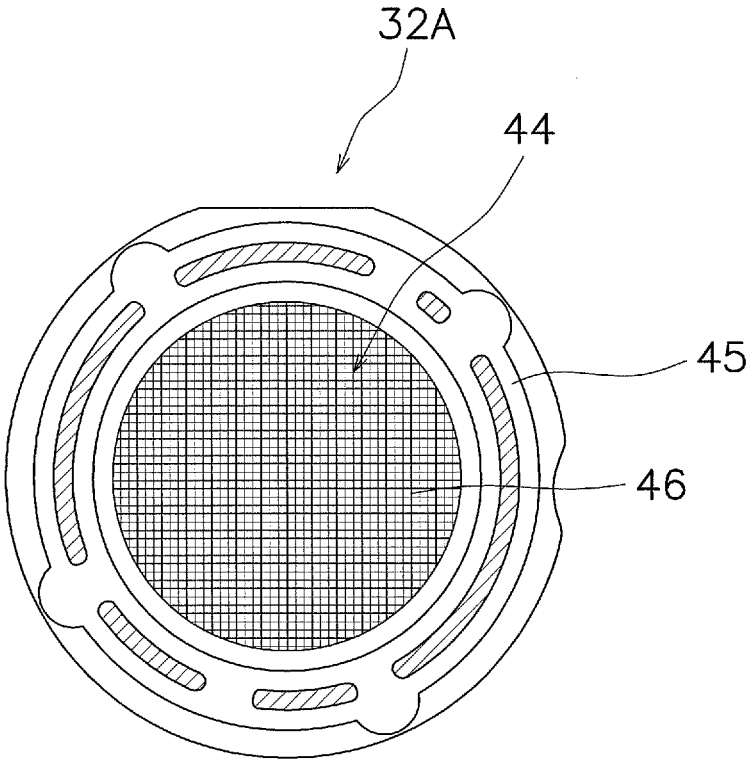
FIG. 7 is a cross-sectional view of a catalyst unit according to the first preferred embodiment of the present invention.

A catalyst unit 32A is provided separately from the cylinder head 22 and the cylinder block 21. The catalyst unit 32A is also separate from the exhaust manifold 31. The catalyst unit 32A is attached to the cylinder head 22 and the cylinder block 21. The catalyst unit 32A includes a catalyst member 44 and a pipe 45, as shown in FIGS. 4 and 6. The catalyst member 44 is disposed inside the pipe 45. The catalyst member 44 is positioned above the bottom end portion of the cylinder 21*d*, which is the lowest-positioned of the four cylinders 21*a* to 21*d*. The pipe 45 houses the catalyst member 44. The pipe 45 directs exhaust downward from the exhaust manifold 31. The exhaust passing through the exhaust passage 16 passes through the catalyst member 44 inside the pipe 45, and is cleaned as a result. FIG. 7 is a cross-sectional view perpendicular to the axial direction of the catalyst unit 32A. The catalyst member 44 includes a catalyst carrier 46, as shown in FIG. 7. The catalyst carrier 46 carries a noble metal as a catalyst for cleaning the exhaust. A three-way catalyst, for example, can be used. The catalyst carrier 46 includes a cylindrical member having a honeycomb structure.

The exhaust passage 16, shown in FIG. 1, includes the first passage 33, a second passage 34, and a third passage 35, each shown in FIG. 6, and a fourth passage 38, shown in FIG. 1. The first passage 33 and the second passage 34 are disposed inside the exhaust manifold 31, as shown in FIG. 6. The first passage 33 is connected to the above-described plurality of exhaust ports 25*a* to 25*d*. The first passage 33 is disposed on the side of the cylinder head 22 and extends in a vertical direction. A plurality of first openings 36*a* to 36*d* is provided in the first passage 33, as shown in FIG. 5, and each of the exhaust ports 25*a* to 25*d* is connected to the first passage 33 via each of the first openings 36*a* to 36*d*. The first passage 33 collects the exhaust discharged from the exhaust ports 25*a* to 25*d*.

The second passage 34 is connected to the first passage 33. As shown in FIG. 5, the portion connecting the second passage 34 and the first passage 33 is positioned between the top end of the cylinder 21*a* positioned at the uppermost portion of the plurality of cylinders 21*a* to 21*d*, and the bottom end of the cylinder 21*d* positioned at the lowermost portion of the plurality of cylinders 21*a* to 21*d*. Specifically, the vertical center portion of the portion connecting the second passage 34 and the first passage 33 is positioned higher than the vertical central portion of the first passage 33. More specifically, the portion connecting the second passage 34 and the first passage 33 is positioned at approximately the same height as the second highest cylinder 21*b* of the four cylinders 21*a* to 21*d*. The second passage 34 extends in an anteroposterior direction from the first passage 33. The second passage 34 is parallel or substantially parallel to the central axis line of the cylinders 21*a* to 21*d*. In other words, the second passage 34 extends in a roughly horizontal direction. The second passage 34 also includes an opening 37. The catalyst unit 32A is connected to the opening 37.

The third passage 35 includes the pipe 45 of the catalyst unit 32A and a first lower passage 51, as shown in FIG. 6. The pipe 45 and the first lower passage 51 are separate from each other. The third passage 35 is connected to the second passage 34. The third passage 35 extends downward from the second passage 34. Therefore, the third passage 35 is disposed parallel or substantially parallel to the crankshaft 26 (see FIG. 1). The third passage 35 is disposed on the side of the cylinder block 21. The first lower passage 51 is disposed inside the cylinder block 21. The first lower passage 51 includes an opening 54. The opening 54 is provided at the upstream-side end portion of the first lower passage 51. The opening 54 is provided on the lower portion of the lateral face of the cylinder block 21. The first lower passage 51 is connected to the catalyst unit 32A via the opening 54. In other words, the downstream-side end portion of the pipe 45 is connected to the upstream-side end portion of the first lower passage 51. A water capture member 47 is disposed downstream of the catalyst member 44 inside the third passage 35. Specifically, the water capture member 47 is disposed in the first lower passage 51, and is positioned below the catalyst member 44. The water capture member 47 includes a cylindrical member having the same or substantially the same honeycomb structure as the catalyst carrier 46 of the catalyst unit 32A. The water capture member 47 may be made from a metal honeycomb or ceramic honeycomb, for example. Also, the water capture member 47 may or may not include a catalyst. The water capture member 47 preferably has a smaller outside diameter than does the catalyst carrier 46 of the catalyst unit 32A.

The fourth passage 38, as shown in FIG. 1, guides the exhaust from the exhaust ports 25*a* to 25*d* below the engine 6 and discharges the exhaust to the outside via the propeller boss 13. The fourth passage 38 is positioned below the engine 6. The fourth passage 38 includes a second lower passage 52 and a third lower passage 53. The second lower passage 52 is disposed inside the exhaust guide section 4. The second lower passage 52 is connected to the first lower passage 51, as shown in FIGS. 4 and 6. The third lower passage 53 is disposed inside the lower casing 3, as shown in FIG. 1. The third lower passage 53 is connected to the second lower passage 52. The third lower passage 53 is also connected to the propeller boss 13.

In the outboard motor 1 according to the present preferred embodiment, the exhaust from the exhaust ports 25*a* to 25*d* of the engine 6 is collected in the first passage 33. The exhaust flows from the first passage 33 through the second passage 34 to the third passage 35. The exhaust is cleaned by being passed through the catalyst member 44 in the third passage 35. The exhaust flows from the third passage 35 to the fourth passage 38. The exhaust is sent downward from the engine 6 by being passed through the fourth passage 38. Then, the exhaust passes through the inside of the propeller boss 13 from the fourth passage 38 and is discharged outside the outboard motor 1.

A linking passage 43 is connected to the bottom end portion of the first passage 33, as shown in FIGS. 5 and 6. The linking passage 43 passes through a wall section of the cylinder block 21 and is linked to the first lower passage 51, discussed below. Therefore, the linking passage 43 links the bottom end portion of the first passage 33 and the first lower passage 51. More specifically, the linking passage 43 links a portion of the first lower passage 51 positioned downstream of the water capture member 47 and the bottom end portion of the first passage 33. The linking passage 43 has a smaller cross-sectional area than the cross-sectional area of the opening 37. Because of this, the exhaust discharged from the linking passage 43 is negligible in comparison with the opening 37. By contrast, the condensed water generated inside the first passage 33 flows to the first lower passage 51 via the linking passage 43. Then, the condensed water passes through the fourth passage 38 and is discharged outside via the propeller boss 13. The linking passage 43 thus functions as a condensed water removal passage such that the condensed water generated inside the first passage 33 is removed from the first passage 33.

The catalyst unit 32A also includes a first oxygen sensor 55 and a second oxygen sensor 56 arranged to detect an oxygen concentration in the exhaust, as shown in FIGS. 3 and 4. The first oxygen sensor 55 is disposed upstream of the catalyst member 44 in the exhaust passage 16. Specifically, the first oxygen sensor 55 is disposed above the catalyst member 44 in the pipe 45. The second oxygen sensor 56 is disposed below the catalyst member 44 in the pipe 45. The second oxygen sensor 56 is disposed downstream of the catalyst member 44 in the exhaust passage 16. Specifically, the second oxygen sensor 56 is disposed between the catalyst member 44 and the water capture member 47 in the exhaust passage 16. That is, the water capture member 47 is disposed between the second oxygen sensor 56 and the linking passage 43 in the exhaust passage 16. A detection signal from the first oxygen sensor 55 and the second oxygen sensor 56 is supplied to an ECU (not shown). The ECU controls the engine 6 on the basis of the detection value from the first oxygen sensor 55 and the second oxygen sensor 56.

Figure 8:
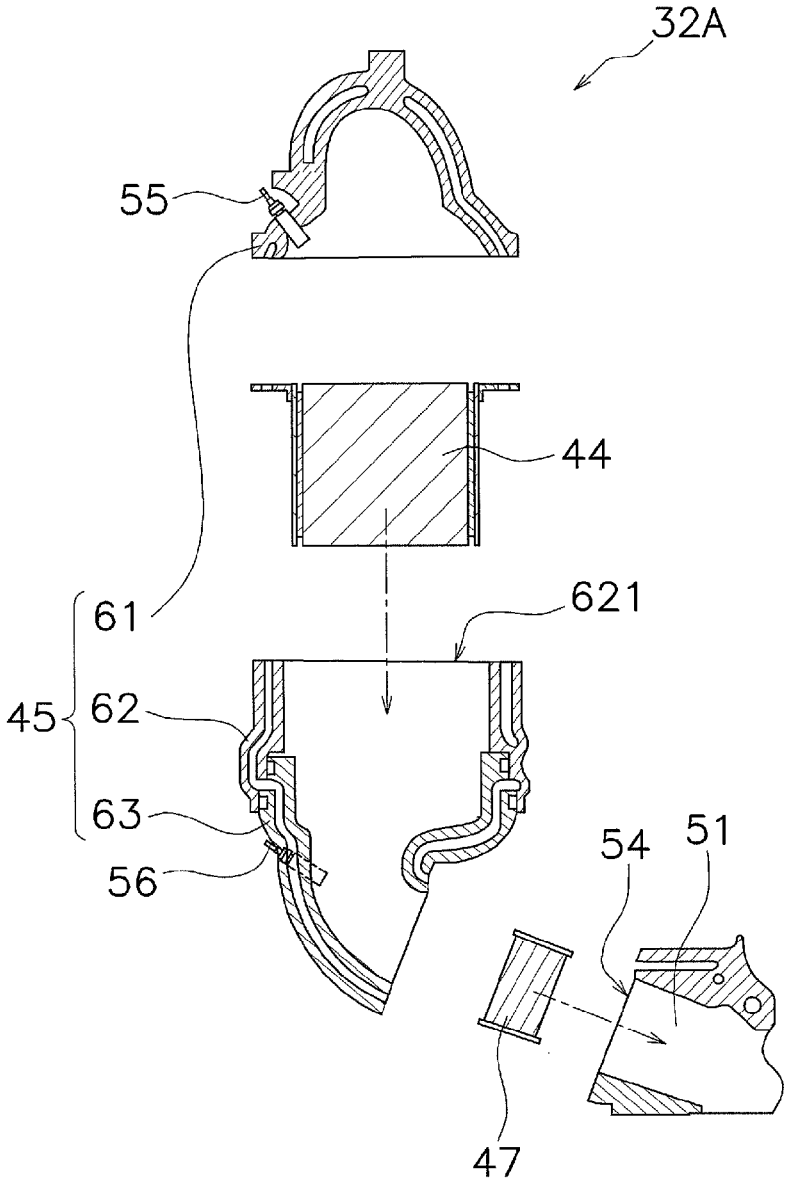
FIG. 8 is an exploded cross-sectional view of a catalyst unit according to the first preferred embodiment of the present invention.

FIG. 8 is an exploded cross-sectional view of the catalyst unit 32A. The pipe 45 is divisibly composed of a first pipe section 61, a second pipe section 62, and a third pipe section 63, as shown in FIG. 8. The upstream-side end portion of the first pipe section 61 is connected to the exhaust manifold 31. The downstream-side end portion of the first pipe section 61 is connected to the upstream-side end portion of the second pipe section 62. The downstream-side end portion of the second pipe section 62 is connected to the upstream-side end portion of the third pipe section 63. In the present preferred embodiment, the second pipe section 62 corresponds to the first exhaust passage. The first lower passage 51 corresponds to the second exhaust passage.

The first oxygen sensor 55 is mounted in the first pipe section 61. The second oxygen sensor 56 is mounted in the third pipe section 63. An opening 621 is provided at the upstream-side end portion of the second pipe section 62. The catalyst member 44 can be inserted into the opening 621. The opening 54 is provided at the upstream-side end portion of the first lower passage 51. The water capture member 47 can be inserted into the opening 54.

The second pipe section 62 is mounted on the third pipe section 63 during assembly of the catalyst unit 32A. The catalyst member 44 is passed through the opening 621 and press-fitted into the second pipe section 62. The first pipe section 61 is thereafter mounted on the second pipe section 62. The water capture member 47 is passed through the opening 54 and press-fitted into the first lower passage 51. The third pipe section 63 is thereafter mounted on the first lower passage 51. In other words, the pipe 45 is mounted on the first lower passage 51.

Figure 9:
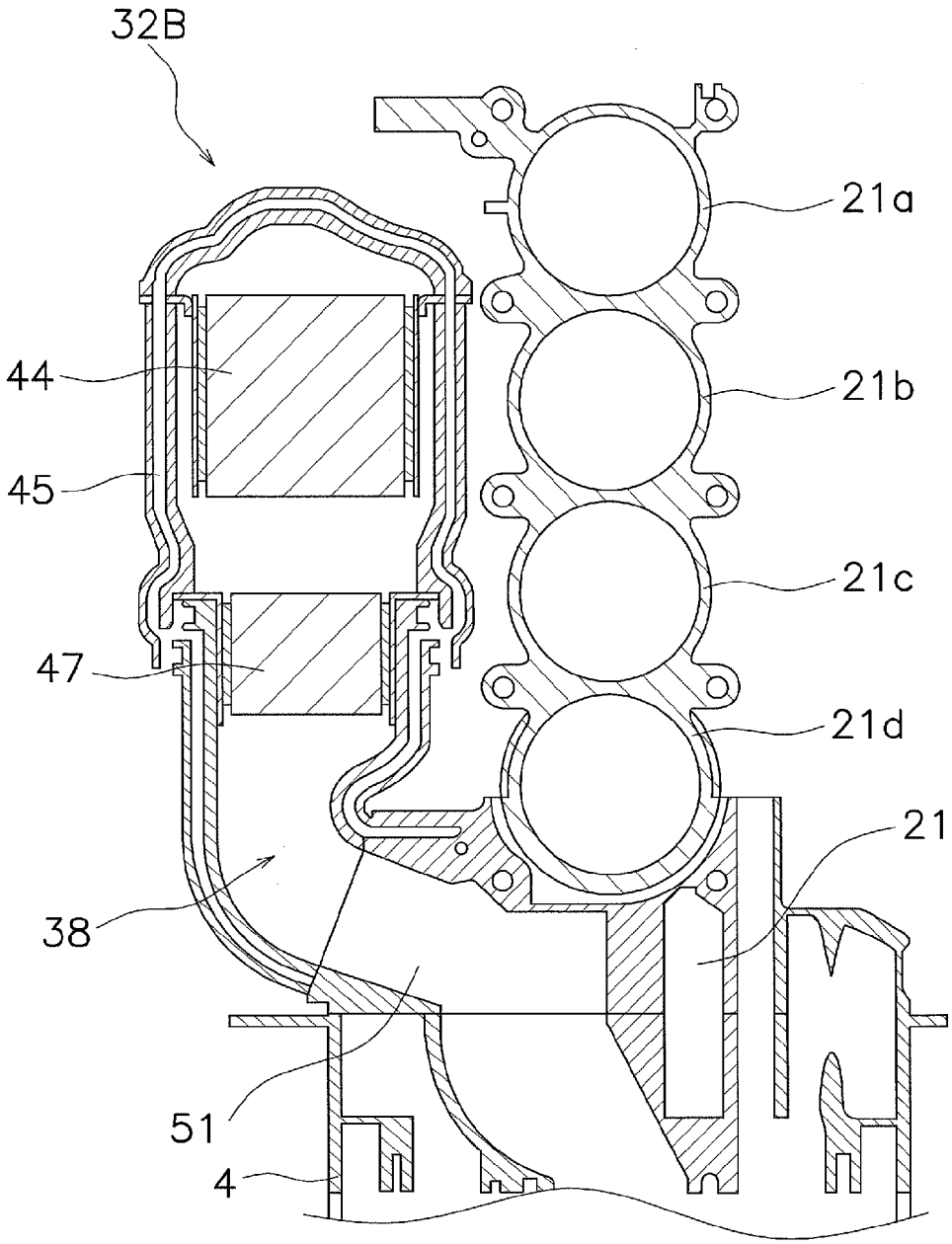
FIG. 9 is a cross-sectional view of a configuration of a catalyst unit according to a second preferred embodiment of the present invention.

FIG. 9 is a cross-sectional view showing a catalyst unit 32B of the outboard motor according to a second preferred embodiment of the present invention. The water capture member 47 may be disposed in the pipe 45 of the catalyst unit 32B, rather than in the first lower passage 51, as shown in FIG. 9. Specifically, the water capture member 47 may be disposed downstream of the catalyst member 44 in the pipe 45. In this case, the water capture member 47 can be disposed in a higher position compared with a case in which the water capture member 47 is disposed in the first lower passage 51. The possibility of the catalyst member 44 and the second oxygen sensor 56 becoming wet can thus be reduced. Because the outside diameter of the water capture member 47 can easily be enlarged, the pressure loss inside the water capture member 47 can also be reduced.

Figure 10:
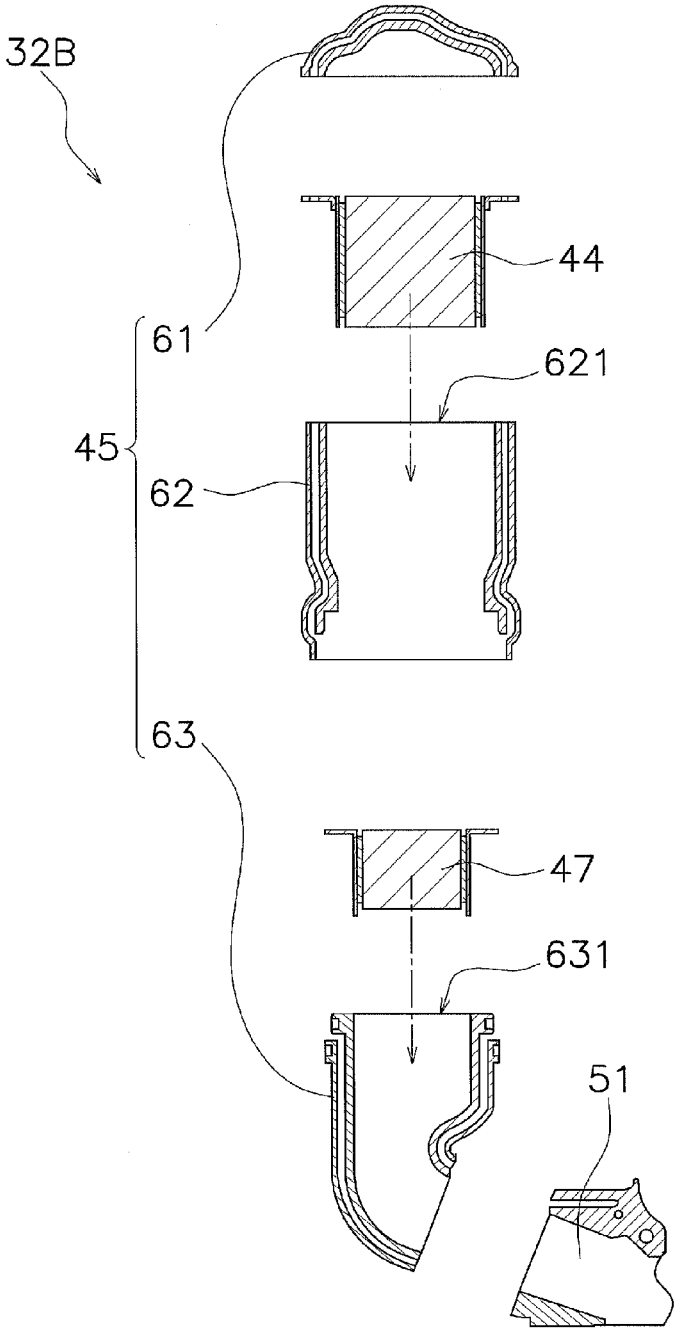
FIG. 10 is an exploded cross-sectional view of a catalyst unit according to the second preferred embodiment of the present invention.

FIG. 10 is an exploded cross-section of the catalyst unit 32B according to the second preferred embodiment. The pipe 45 includes a first pipe section 61, a second pipe section 62, and a third pipe section 63, as shown in FIG. 10. The first pipe section 61, the second pipe section 62, and the third pipe section 63 are separate and independent members that are connected to each other. The upstream-side end portion of the first pipe section 61 is connected to the exhaust manifold 31. The downstream-side end portion of the first pipe section 61 is connected to the upstream-side end portion of the second pipe section 62. The downstream-side end portion of the second pipe section 62 is connected to the upstream-side end portion of the third pipe section 63. The downstream-side end portion of the third pipe section 63 is connected to the first lower passage 51. In the present preferred embodiment, the second pipe section 62 corresponds to the first exhaust passage. The third pipe section 63 corresponds to the second exhaust passage.

The opening 621 is provided at the upstream-side end portion of the second pipe section 62. The catalyst member 44 can be inserted into the opening 621. An opening 631 is provided at the upstream-side end portion of the third pipe section 63. The water capture member 47 can be inserted into the opening 631. The configuration of the outboard motor according to the second preferred embodiment is otherwise preferably the same as the configuration of the outboard motor 1 according to the first preferred embodiment.

The catalyst member 44 is passed through the opening 621 and press-fitted into the second pipe section 62 during assembly of the catalyst unit 32B. The first pipe section 61 is thereafter mounted on the second pipe section 62. The water capture member 47 is passed through the opening 631 and press-fitted into the third pipe section 63. The second pipe section 62 is thereafter mounted on the third pipe section 63. The first pipe section 61 is mounted on the exhaust manifold 31. The third pipe section 63 is mounted on the first lower passage 51.

Figure 11:
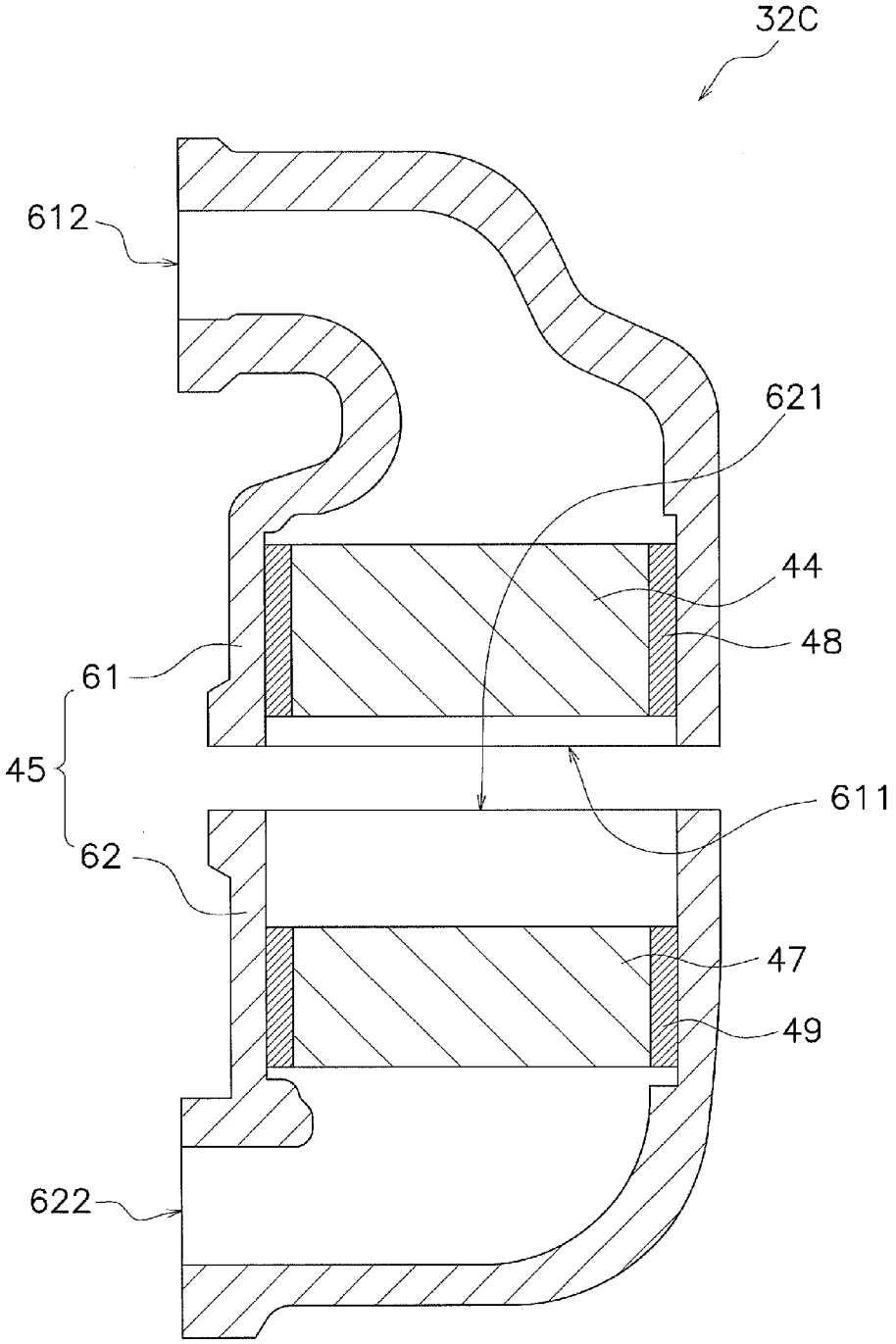
FIG. 11 is an exploded cross-sectional view of a catalyst unit according to a third preferred embodiment of the present invention.

FIG. 11 is an exploded cross-sectional view of a catalyst unit 32C of the outboard motor according to the third preferred embodiment of the present invention. As shown in FIG. 11, the pipe 45 of the catalyst unit 32C includes a first pipe section 61 and a second pipe section 62. The upstream-side end portion of the first pipe section 61 is connected to the exhaust manifold 31. The downstream-side end portion of the first pipe section 61 is connected to the upstream-side end portion of the second pipe section 62. The downstream-side end portion of the second pipe section 62 is connected to the first lower passage 51.

In the present preferred embodiment, the first pipe section 61 and the passage on the upstream side from the first pipe section 61 in the exhaust passage 16 correspond to the first exhaust passage. In other words, the first exhaust passage includes the exhaust manifold 31 and the first pipe section 61. The second pipe section 62 and the passage on the downstream side from the second pipe section 62 in the exhaust passage 16 correspond to the second exhaust passage. In other words, the second exhaust passage includes the second pipe section 62, the first lower passage 51, and the fourth passage 38.

The exhaust manifold 31 corresponds to the upstream-side portion of the first exhaust passage that directs exhaust upward from the exhaust ports 25*a* to 25*d* below. The first pipe section 61 corresponds to the downstream-side portion of the first exhaust passage that directs exhaust downward from the upstream-side portion.

The second pipe section 62 corresponds to the upstream-side portion of the second exhaust passage that directs exhaust downward from the first exhaust passage in the upper casing 2 above. The fourth passage 38 corresponds to the downstream-side portion of the second exhaust passage that directs exhaust from the upstream-side portion of the second exhaust passage to the exterior of the upper casing 2.

The catalyst member 44 is disposed inside the first pipe section 61. An opening 611 is provided at the downstream-side end portion of the first pipe section 61. The catalyst member 44 can be inserted into the opening 611. A first holding mat 48 is wound onto the catalyst member 44. The first holding mat 48 is made from, e.g., alumina fiber. However, the first holding mat 48 may be made from a material other than alumina fiber. An opening 612 is provided at the upstream-side end portion of the first pipe section 61. The opening 612 has a smaller diameter than does the opening 611, and the catalyst member 44 cannot be inserted into the opening 612.

The water capture member 47 is disposed inside the second pipe section 62. The opening 621 is provided at the upstream-side end portion of the second pipe section 62. The water capture member 47 can be inserted into the opening 621. A second holding mat 49 is wound onto the water capture member 47. The second holding mat 49 is made from, e.g., alumina fiber. However, the second holding mat 49 may be made from a material other than alumina fiber. An opening 622 is provided at the downstream-side end portion of the second pipe section 62. The opening 622 has a smaller diameter than does the opening 621, and the water capture member 47 cannot be inserted into the opening 622. The catalyst member 44 and the water capture member 47 preferably have the same outside diameter. The opening 611 and the opening 621 preferably have the same inside diameter. The configuration of the outboard motor according to the third preferred embodiment is otherwise preferably the same as the configuration of the outboard motor 1 according to the first preferred embodiment.

The catalyst member 44 is passed through the opening 611 and press-fitted into the first pipe section 61 during assembly of the catalyst unit 32C. The water capture member 47 is passed through the opening 621 and press-fitted into the second pipe section 62. The first pipe section 61 is thereafter mounted on the second pipe section 62. The first pipe section 61 is mounted on the exhaust manifold 31. The second pipe section 62 is mounted on the first lower passage 51.

Figure 21:
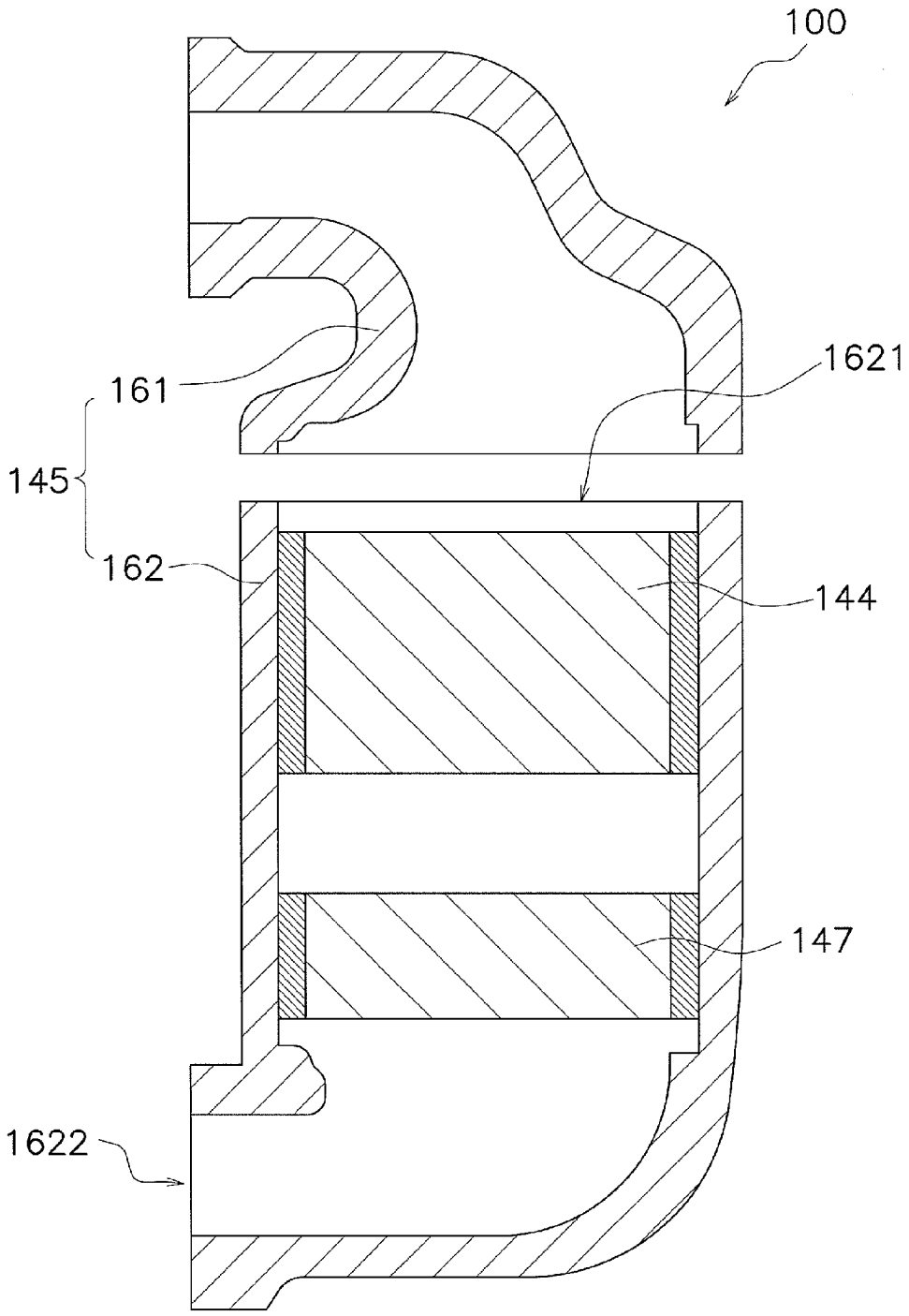
FIG. 21 is an exploded cross-sectional view of a catalyst unit according to a comparative example.

FIG. 21 is an exploded cross-sectional view of the catalyst unit 100 according to a comparative example. A pipe 145 of the catalyst unit 100 includes a first pipe section 161 and a second pipe section 162, as shown in FIG. 21. The first pipe section 161 and the second pipe section 162 are separate and independent members that are connected to each other. The upstream-side end portion of the first pipe section 161 is connected to the exhaust manifold 31. The downstream-side end portion of the first pipe section 161 is connected to the upstream-side end portion of the second pipe section 162. The downstream-side end portion of the second pipe section 162 is connected to the first lower passage 51.

A catalyst member 144 and a water capture member 147 are both disposed inside the second pipe section 162. The outside diameter of the catalyst member 144 and the outside diameter of the water capture member 147 are preferably the same. An opening 1621 is provided at the upstream-side end portion of the second pipe section 162. The catalyst member 144 and the water capture member 147 can be inserted into the upstream-side opening 1621 of the second pipe section 62. An opening 1622 is provided at the downstream-side end portion of the second pipe section 162. The downstream-side opening 1622 of the second pipe section 62 has a smaller diameter than does the upstream-side opening 1621, and the catalyst member 144 and the water capture member 147 cannot be inserted into the downstream-side opening 1622.

The water capture member 147 is passed through the upstream-side opening 1621 of the second pipe section 162 and press-fitted into the second pipe section 162 during assembly of the catalyst unit 100 according to the comparative example. The catalyst member 144 is thereafter passed through the opening 1621 in similar fashion and press-fitted into the second pipe section 162. Therefore, in the catalyst unit 100 according to the comparative example, the surface roughness of the inner surface of the second pipe section 162 is reduced by the friction between the water capture member 147 previously press-fitted into the second pipe section 162. Accordingly, the function of the second pipe section 162 of holding the later-press-fitted catalyst member 144 is reduced.

In contrast, in the catalyst unit 32C according to the present preferred embodiment, the inner surface of the second pipe section 62 is not affected by the catalyst member 44 being press-fitted into the first pipe section 61. Also, the inner surface of the first pipe section 61 is not affected by the water capture member 47 being press-fitted into the second pipe section 62. The force for holding the catalyst member 44 and the water capture member 47 in the exhaust passage 16 can thus be improved.

Figure 12:
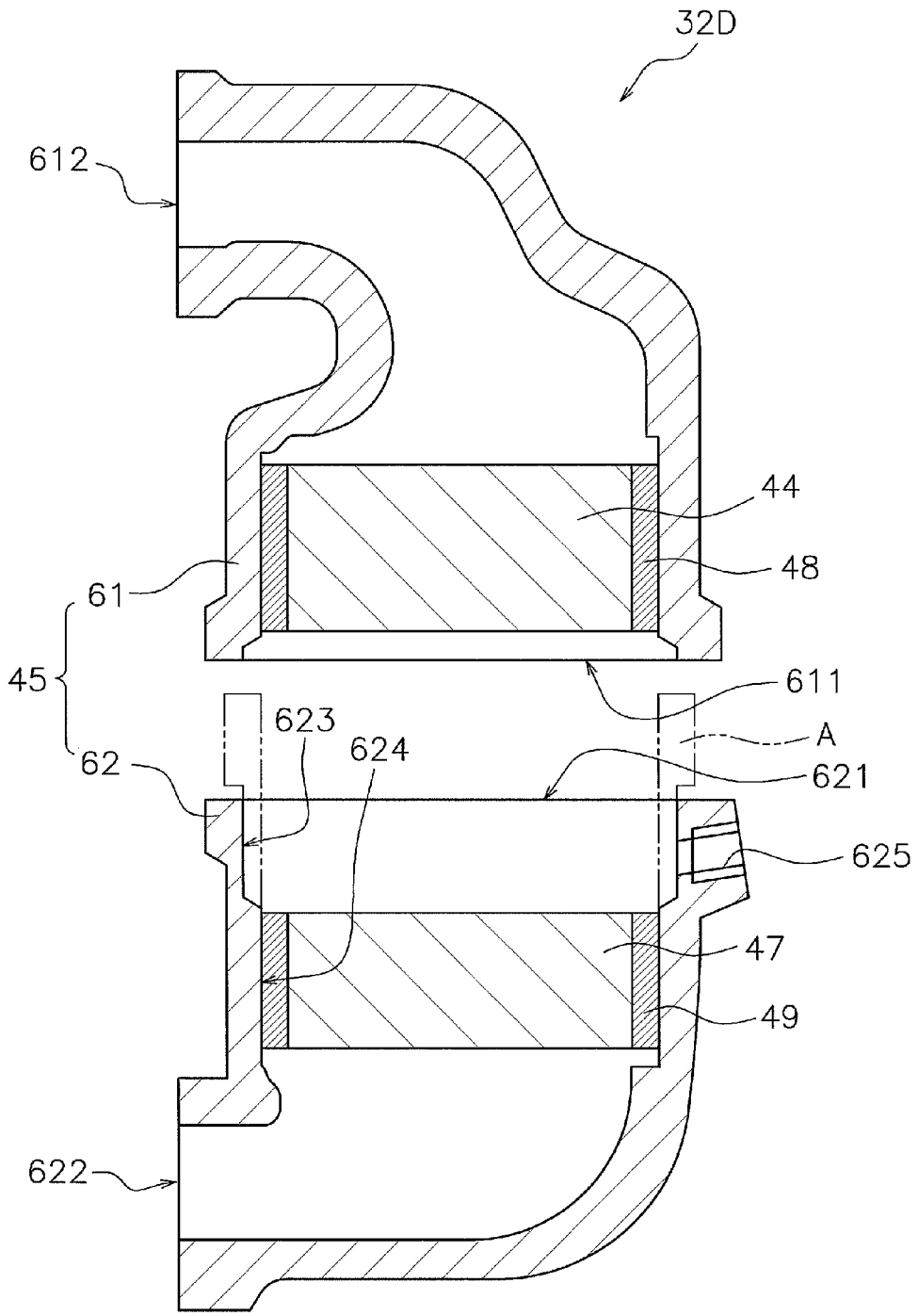
FIG. 12 is an exploded cross-sectional view of a catalyst unit according to a fourth preferred embodiment of the present invention.

FIG. 12 is an exploded cross-sectional view of a catalyst unit 32D of the outboard motor according to the fourth preferred embodiment of the present invention. A recessed portion 623 is provided in the inner surface of the second pipe section 62, as shown in FIG. 12. The recessed portion 623 is provided along the circumferential direction of the second pipe section 62 such that the recessed portion 623 has an inner diameter that is larger than an inner diameter of the non-recessed portion of the second pipe section 62. The recessed portion 623 is disposed between the catalyst member 44 and the water capture member 47. The recessed portion 623 is provided between the water capture member 47 and the opening 621 in the inner surface of the second pipe section 62. Therefore, the recessed portion 623 is positioned further to the upstream side in the second pipe section 62 than is the water capture member 47.

The second pipe section 62 includes a honeycomb accommodation section 624. The honeycomb accommodation section 624 is a portion in which the water capture member 47 is disposed in the second pipe section 62. The inside diameter of the recessed portion 623 is greater than the inside diameter of the honeycomb accommodation section 624. The recessed portion 623 is large enough to accommodate a press-fitting jig A used to press-fit the water capture member 47 into the second pipe section 62. In other words, the inside diameter of the recessed portion 623 is substantially the same as the outside diameter of the press-fitting jig A. A hole 625 arranged to receive the oxygen sensor 56 is provided in the recessed portion 623. The hole 625 is disposed between the catalyst member 44 and the water capture member 47. The hole 625 is positioned between the opening 621 and the honeycomb accommodation section 624 of the second pipe section 62. The oxygen sensor 56 is mounted in the hole 625, such that the oxygen sensor 56 is disposed between the catalyst member 44 and the water capture member 47. The configuration of the catalyst unit 32D according to the fourth preferred embodiment is otherwise preferably the same as the configuration of the catalyst unit 32C according to the third preferred embodiment.

The catalyst member 44 is passed through the opening 611 and press-fitted into the first pipe section 61 during assembly of the catalyst unit 32D. Also, the water capture member 47 is passed through the opening 621 and is press-fitted into the second pipe section 62. At this time, the water capture member 47 is press-fitted into the second pipe section 62 in a state in which the press-fitting jig A has been accommodated in the recessed portion 623 and the hole 625 has thereby been blocked off by the press-fitting jig A. The press-fitting jig A is thereafter removed from the recessed portion 623 and the first pipe section 61 is mounted on the second pipe section 62. Also, the first pipe section 61 is mounted on the exhaust manifold 31. The second pipe section 62 is mounted on the first lower passage 51. The oxygen sensor 56 is inserted into the hole 625.

In the catalyst unit 32D according to the present preferred embodiment, the water capture member 47 is press-fitted into the second pipe section 62 in a state in which the hole 625 has been blocked off by the press-fitting jig A. Therefore, the second holding mat 49 is prevented from catching on the edge of the hole 625 during the press-fitting step. Accordingly, the second holding mat 49 is prevented from being damaged. The force for holding the water capture member 47 can thus be improved.

Figure 13:
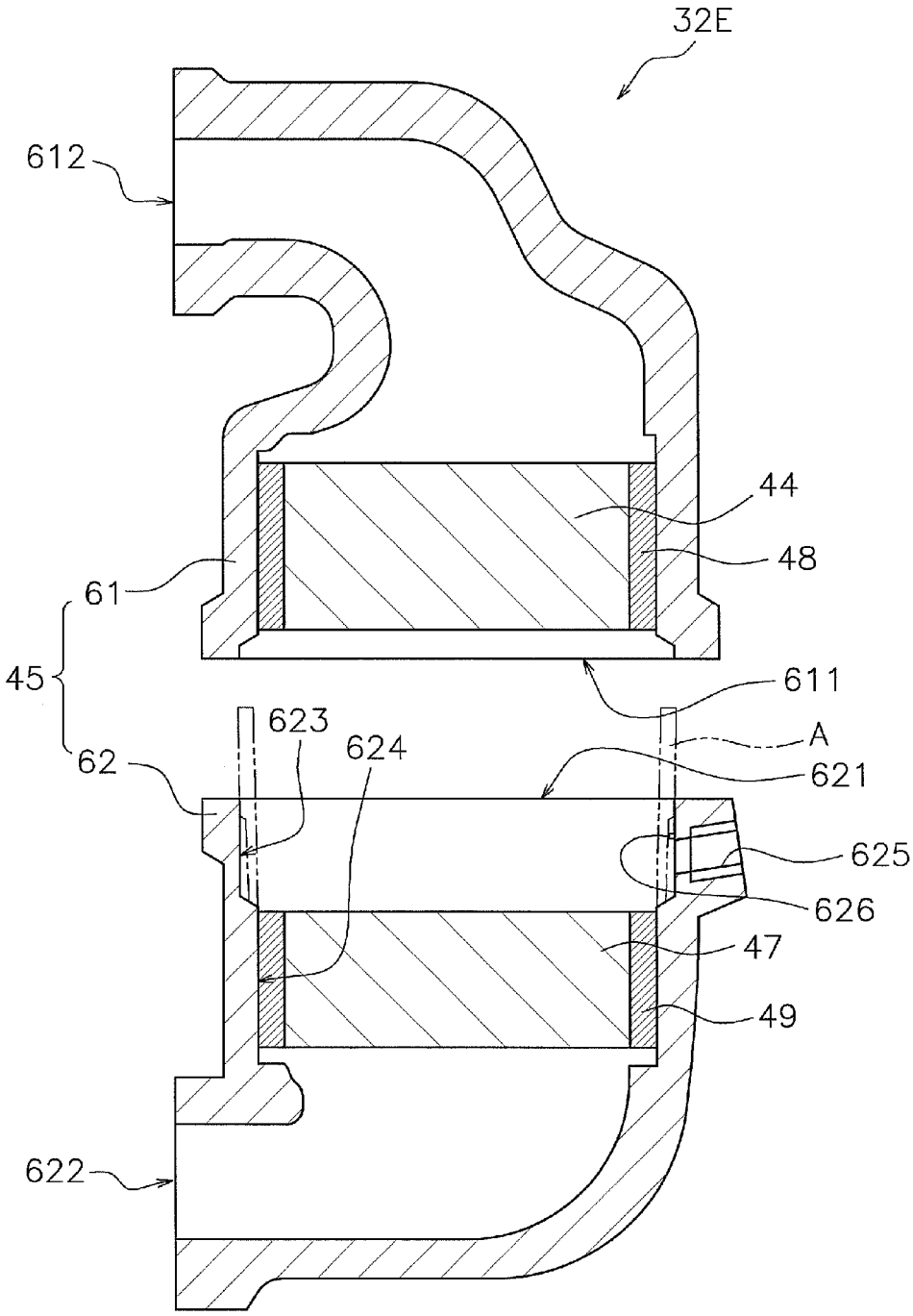
FIG. 13 is an exploded cross-sectional view of a catalyst unit according to a fifth preferred embodiment of the present invention.

FIG. 13 is an exploded cross-sectional view of a catalyst unit 32E of the outboard motor according to the fifth preferred embodiment of the present invention. The second pipe section 62 includes a rib 626, as shown in FIG. 13. The rib 626 protrudes from the bottom surface of the recessed portion 623. The rib 626 is positioned between the hole 625 and the opening 621 in the second pipe section 62. The rib 626 is positioned further to the upstream side than is the hole 625 in the second pipe section 62. The height of the rib 626 from the bottom surface of the recessed portion 623 is less than the depth of the recessed portion 623. In other words, the distal end portion of the rib 626 is positioned further outward in the radial direction than is the inner surface of the honeycomb accommodation section 624. The configuration of the catalyst unit 32E according to the fifth preferred embodiment is otherwise preferably the same as the configuration of the catalyst unit 32D according to the fourth preferred embodiment.

In the catalyst unit 32E according to the present preferred embodiment, water exposure of the oxygen sensor 56 can be minimized by the rib 626. Also, the height of the rib 626 from the bottom surface of the recessed portion 623 is less than the depth of the recessed portion 623, and interference of the rib 626 with the water capture member 47 can therefore be minimized when the water capture member 47 is press-fitted into the second pipe section 62.

Figure 14:
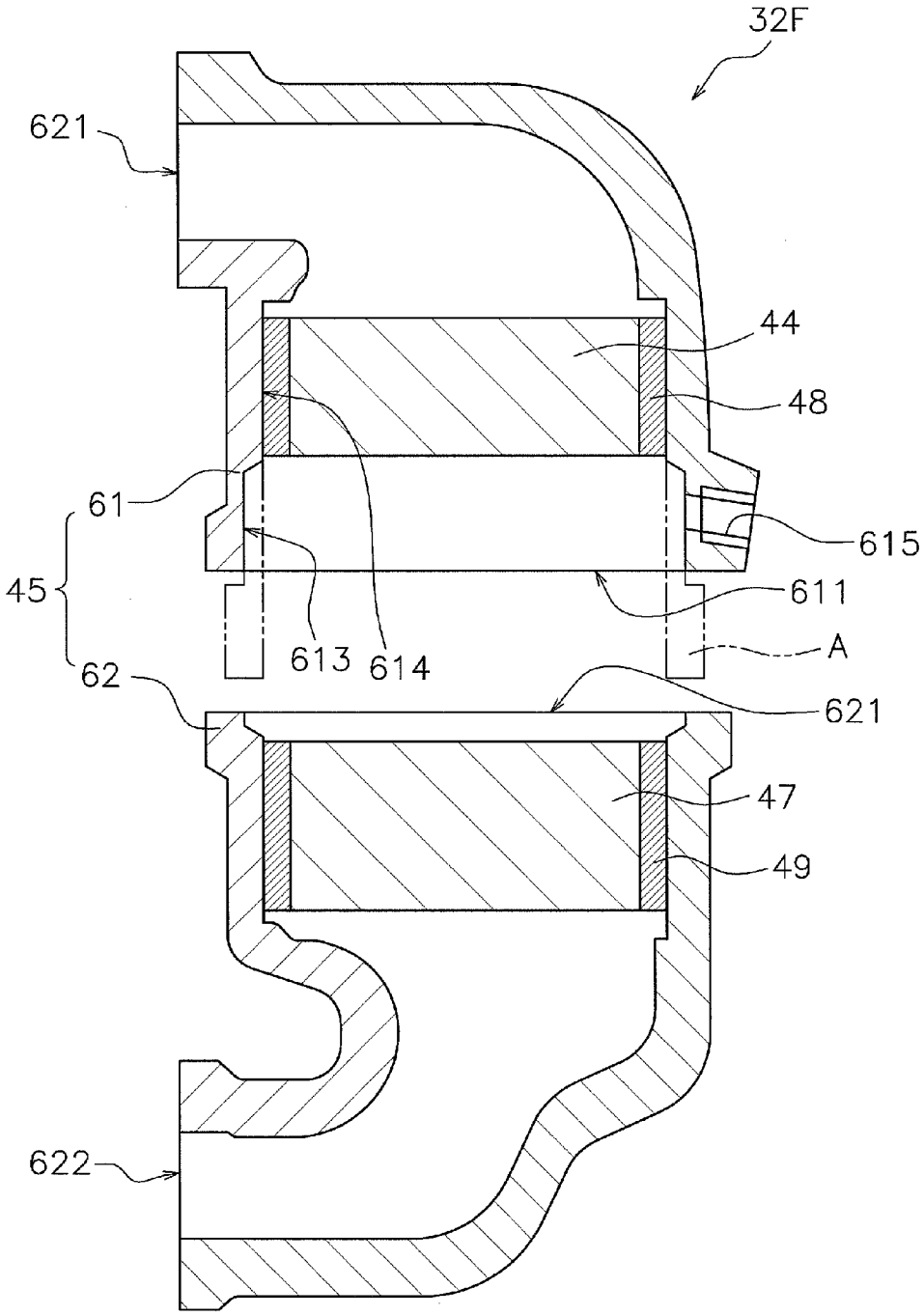
FIG. 14 is an exploded cross-sectional view of a catalyst unit according to a sixth preferred embodiment of the present invention.

FIG. 14 is an exploded cross-sectional view of a catalyst unit 32F of the outboard motor according to the sixth preferred embodiment of the present invention. A recessed portion 613 is provided in the inner surface of the first pipe section 61, as shown in FIG. 14. The recessed portion 613 is provided along the circumferential direction of the first pipe section 61. The recessed portion 613 is disposed between the catalyst member 44 and the water capture member 47. The recessed portion 613 is provided between the catalyst member 44 and the opening 611 in the first pipe section 61. Therefore, the recessed portion 613 is positioned further to the downstream side than is the catalyst member 44 in the first pipe section 61.

The first pipe section 61 includes a honeycomb accommodation section 614. The honeycomb accommodation section 614 is a portion in which the catalyst member 44 is disposed in the first pipe section 61. The inside diameter of the recessed portion 613 is greater than the inside diameter of the honeycomb accommodation section 614. The recessed portion 613 is large enough to accommodate a press-fitting jig A used to press-fit the catalyst member 44 into the first pipe section 61. In other words, the inside diameter of the recessed portion 613 is substantially the same as the outside diameter of the press-fitting jig A. A hole 615 arranged to receive the oxygen sensor 56 is provided in the recessed portion 613. The hole 615 is disposed between the honeycomb accommodation section 614 and the opening 611. The oxygen sensor 56 is mounted in the hole 615, such that the oxygen sensor 56 is disposed between the catalyst member 44 and the water capture member 47. The configuration of the catalyst unit 32F according to the sixth preferred embodiment is otherwise preferably the same as the configuration of the catalyst unit 32C according to the third preferred embodiment.

The catalyst member 44 is passed through the opening 611 and press-fitted into the first pipe section 61 during assembly of the catalyst unit 32F. At this time, the catalyst member 44 is press-fitted into the first pipe section 61 in a state in which the press-fitting jig A has been accommodated in the recessed portion 613 and the hole 615 has been blocked off by the press-fitting jig A. The press-fitting jig A is thereafter removed from the recessed portion 613. Also, the water capture member 47 is passed through the opening 621 and press-fitted into the second pipe section 62. The first pipe section 61 is thereafter mounted onto the second pipe section 62. The first pipe section 61 is mounted on the exhaust manifold 31. The second pipe section 62 is mounted on the first lower passage 51. The oxygen sensor 56 is inserted into the hole 615.

In the catalyst unit 32F according to the present preferred embodiment, the catalyst member 44 is press-fitted into the first pipe section 61 in a state in which the hole 615 has been blocked off by the press-fitting jig A. Therefore, the first holding mat 48 is prevented from catching on the hole 615 during the press-fitting step. Accordingly, the first holding mat 48 is prevented from being damaged. The force for holding the catalyst member 44 can thus be improved.

Figure 15:
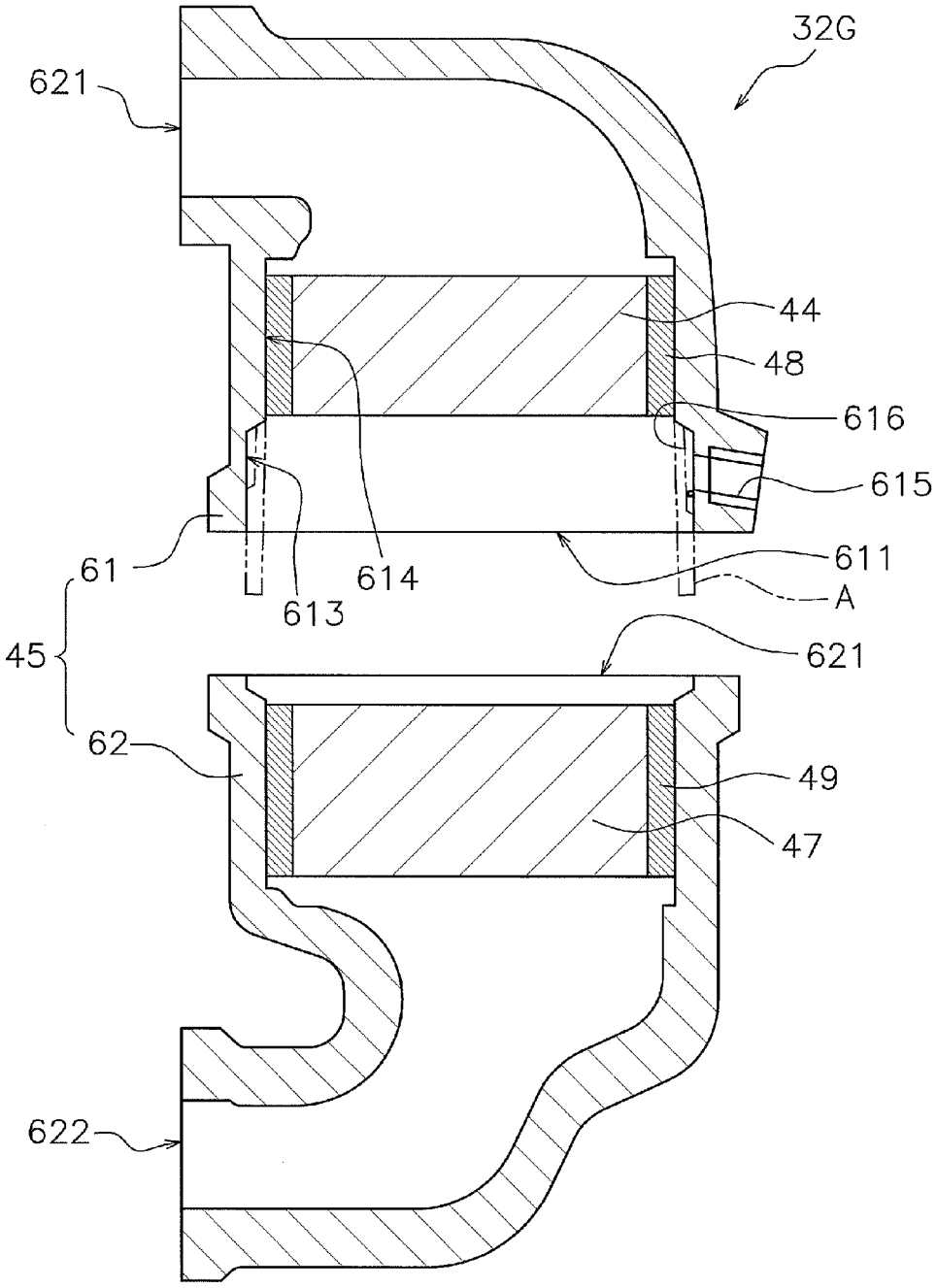
FIG. 15 is an exploded cross-sectional view of a catalyst unit according to a seventh preferred embodiment of the present invention.

FIG. 15 is an exploded cross-sectional view of a catalyst unit 32G of the outboard motor according to the seventh preferred embodiment of the present invention. The first pipe section 61 includes a rib 616, as shown in FIG. 15. The rib 616 protrudes from the bottom surface of the recessed portion 613. The rib 616 is positioned between the hole 615 and the opening 611. The rib 616 is positioned further to the upstream side than is the hole 615. The height of the rib 616 from the bottom surface of the recessed portion 613 is less than the depth of the recessed portion 613. In other words, the distal end portion of the rib 616 is positioned further outward in the radial direction than is the inner surface of the honeycomb accommodation section 614. The configuration of the catalyst unit 32G according to the seventh preferred embodiment is otherwise preferably the same as the configuration of the catalyst unit 32F according to the sixth preferred embodiment.

In the catalyst unit 32G according to the present preferred embodiment, water exposure of the catalyst member 44 can be minimized by the rib 616. Also, the height of the rib 616 from the bottom surface of the recessed portion 613 is less than the depth of the recessed portion 613, and interference of the rib 616 with the catalyst member 44 can therefore be minimized when the catalyst member 44 is press-fitted into the first pipe section 61.

Figure 16:
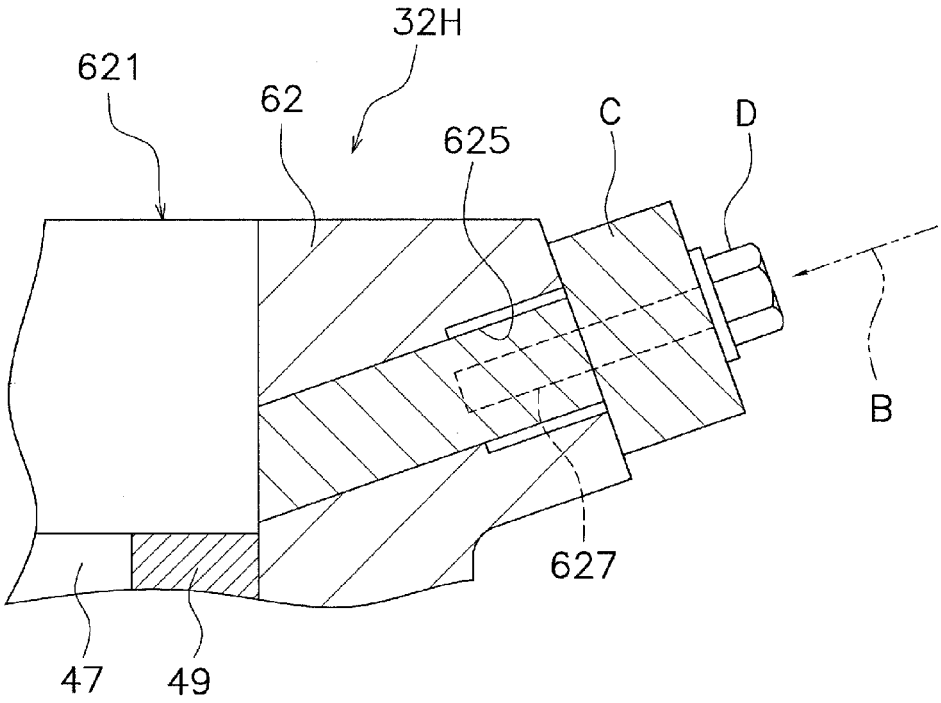
FIG. 16 is an enlarged cross-sectional view of a portion of a catalyst unit according to an eighth preferred embodiment of the present invention.
Figure 17:
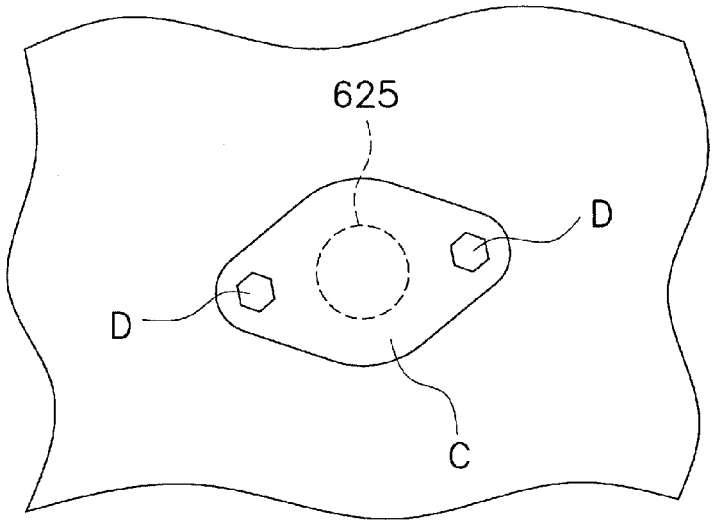
FIG. 17 is an enlarged view of a portion of a catalyst unit according to the eighth preferred embodiment of the present invention.

FIG. 16 is an enlarged cross-sectional view of a portion of a catalyst unit 32H according to the eighth preferred embodiment of the present invention. FIG. 17 is an enlarged view of a portion of the catalyst unit 32H as viewed from the axial direction (see arrow B) of the hole 625 in the second pipe section 62. A mounting section 627 to mount a blocking member C is provided in the outer surface of the second pipe section 62, as shown in FIGS. 16 and 17. The blocking member C is used to block off the hole 625 when the water capture member 47 is press-fitted into the second pipe section 62. The blocking member C is secured to the mounting section 627 in a state disposed in the hole 625. In this state, the distal end of the blocking member C is flush with the inner surface of the second pipe section 62. For example, the mounting section 627 is a hole through which a bolt D is passed, and the blocking member C is mounted on the second pipe section 62 using the bolt D. The configuration of the catalyst unit 32H according to the eighth preferred embodiment is otherwise preferably the same as the configuration of the catalyst unit 32C according to the third preferred embodiment.

The catalyst member 44 is passed through the opening 611 and press-fitted into the first pipe section 61 during assembly of the catalyst unit 32H. The water capture member 47 is passed through the opening 621 and press-fitted into the second pipe section 62. At this time, the water capture member 47 is press-fitted into the second pipe section 62 in a state in which the blocking member C has been mounted in the mounting section 627 and the hole 625 has thus been blocked off by the distal end of the blocking member C. The first pipe section 61 is thereafter mounted onto the second pipe section 62. The first pipe section 61 is mounted onto the exhaust manifold 31. The second pipe section 62 is mounted onto the first lower passage 51. The blocking member C is removed from the hole 625 and the oxygen sensor 56 is inserted into the hole 625.

In the catalyst unit 32H according to the present preferred embodiment, the water capture member 47 is press-fitted into the second pipe section 62 in a state in which the hole 625 is blocked off by the distal end of the blocking member C. Therefore, the second holding mat 49 is prevented from catching on the hole 625 during the press-fitting step. Accordingly, the second holding mat 49 is prevented from being damaged. The force for holding the water capture member 47 can thus be improved. Damage to the second holding mat 49 during press-fitting is prevented without providing a recessed portion 623 such as with the catalyst unit 32D according to the fourth preferred embodiment.

A mounting section similar to the mounting section 627 may be provided in the first pipe section 61 in the case that the hole 615 to mount the oxygen sensor 56 is provided in the first pipe section 61 as with the catalyst unit 32F according to the sixth preferred embodiment.

Figure 18:
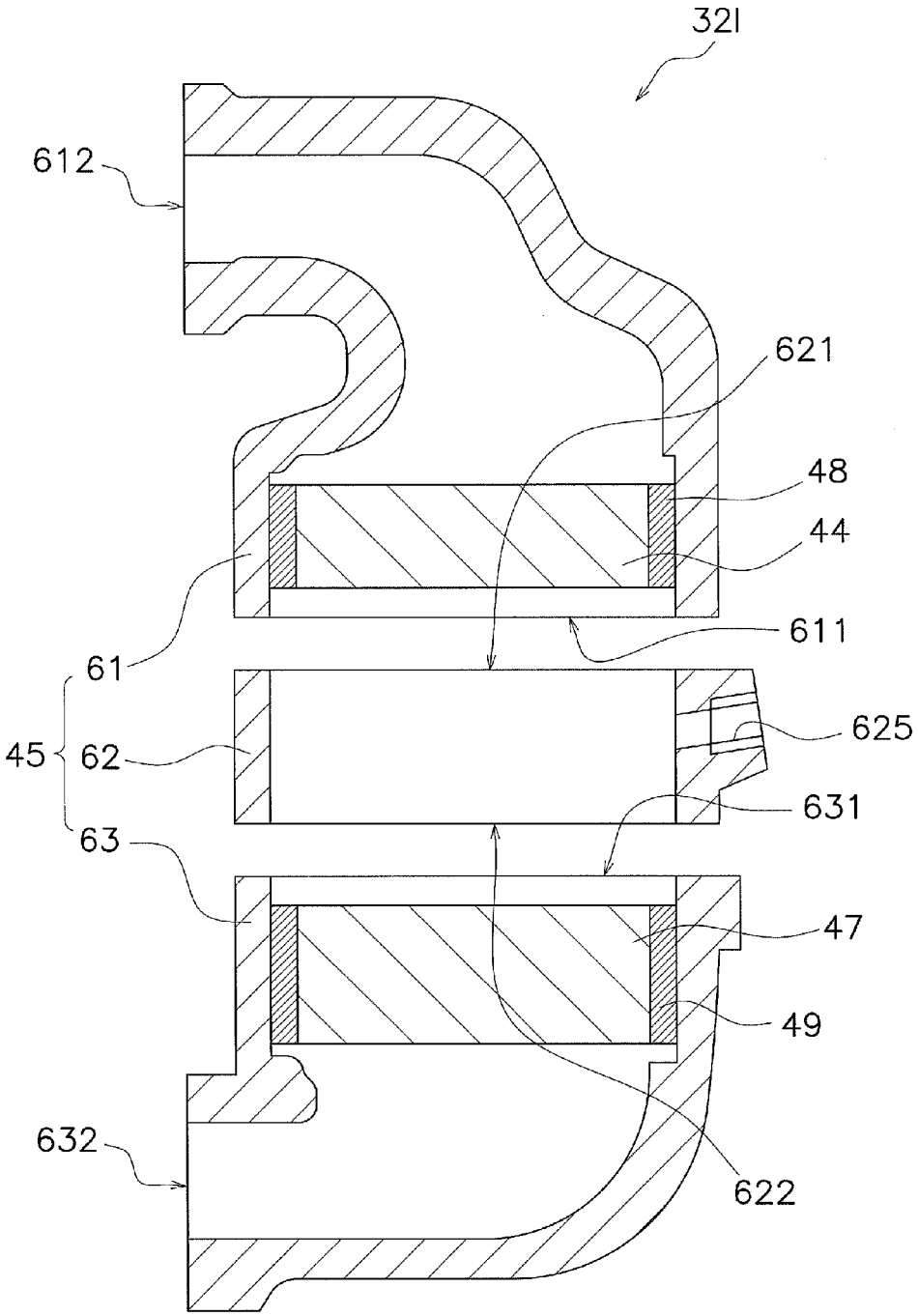
FIG. 18 is an exploded cross-sectional view of a catalyst unit according to a ninth preferred embodiment of the present invention.

FIG. 18 is an exploded cross-sectional view of a catalyst unit 32I of the outboard motor according to the ninth preferred embodiment of the present invention. The pipe 45 of the catalyst unit 32I includes a first pipe section 61, a second pipe section 62, and a third pipe section 63, as shown in FIG. 18. The first pipe section 61, the second pipe section 62, and the third pipe section 63 are separate and independent members that are connected to each other. The second pipe section 62 is disposed between the first pipe section 61 and the third pipe section 63. The upstream-side end portion of the first pipe section 61 is connected to the exhaust manifold 31. The downstream-side end portion of the first pipe section 61 is connected to the upstream-side end portion of the second pipe section 62. The downstream-side end portion of the second pipe section 62 is connected to the upstream-side end portion of the third pipe section 63. The downstream-side end portion of the third pipe section 63 is connected to the first lower passage 51.

In the present preferred embodiment, the first pipe section 61 and the passage on the upstream side from the first pipe section 61 in the exhaust passage 16 correspond to the first exhaust passage. In other words, the first exhaust passage includes the exhaust manifold 31 and the first pipe section 61.

The third pipe section 63 and the passage on the downstream side from the third pipe section 63 in the exhaust passage 16 correspond to the second exhaust passage. In other words, the second exhaust passage includes the third pipe section 63, the first lower passage 51, and the fourth passage 38 in the exhaust passage 16. The second pipe section 62 corresponds to the third exhaust passage.

The catalyst member 44 is disposed in the first pipe section 61. The opening 611 is provided at the downstream-side end portion of the first pipe section 61. The catalyst member 44 can be inserted into the opening 611. The opening 612 is provided at the upstream-side end portion of the first pipe section 61. The opening 612 has a smaller diameter than does the opening 611, and the catalyst member 44 cannot be inserted into the opening 612.

The water capture member 47 is disposed in the third pipe section 63. The opening 631 is provided at the upstream-side end portion of the third pipe section 63. The water capture member 47 can be inserted into the opening 631. An opening 632 is provided at the downstream-side end portion of the third pipe section 63. The opening 632 has a smaller diameter than does the opening 631, and the water capture member 47 cannot be inserted into the opening 632.

The opening 621 is provided at the upstream-side end portion of the second pipe section 62. The opening 622 is provided at the downstream-side end portion of the second pipe section 62. The catalyst member 44 and the water capture member 47 preferably have the same outside diameter. The opening 611 of the first pipe section 61, the opening 631 of the third pipe section 63, and the openings 621 and 622 of the second pipe section preferably have the same inside diameter. A hole 625 arranged to receive the oxygen sensor 56 is provided in the second pipe section 62. The configuration of the outboard motor according to the ninth preferred embodiment is otherwise preferably the same as the configuration of the outboard motor 1 according to the first preferred embodiment.

The catalyst member 44 is passed through the opening 611 and press-fitted into the first pipe section 61 during assembly of the catalyst unit 32I. The water capture member 47 is passed through the opening 631 and press-fitted into the third pipe section 63. The first pipe section 61 is thereafter mounted on the second pipe section 62. The second pipe section 62 is mounted on the third pipe section 63. The first pipe section 61 is mounted on the exhaust manifold 31. The third pipe section 63 is mounted on the first lower passage 51.

In the catalyst unit 32I according to the present preferred embodiment, the hole 625 arranged to receive the oxygen sensor 56 is provided in the second pipe section 62, and the catalyst member 44 therefore does not pass through the hole 625 when the catalyst member 44 is press-fitted into the first pipe section 61. Accordingly, the first holding mat 48 is prevented from being damaged when the catalyst member 44 is press-fitted into the first pipe section 61. Also, the water capture member 47 does not pass through the hole 625 when the water capture member 47 is press-fitted into the third pipe section 631. Accordingly, the second holding mat 49 is prevented from being damaged when the water capture member 47 is press-fitted into the third pipe section 63. The force for holding the catalyst member 44 and the water capture member 47 is thus improved.

Figure 19:
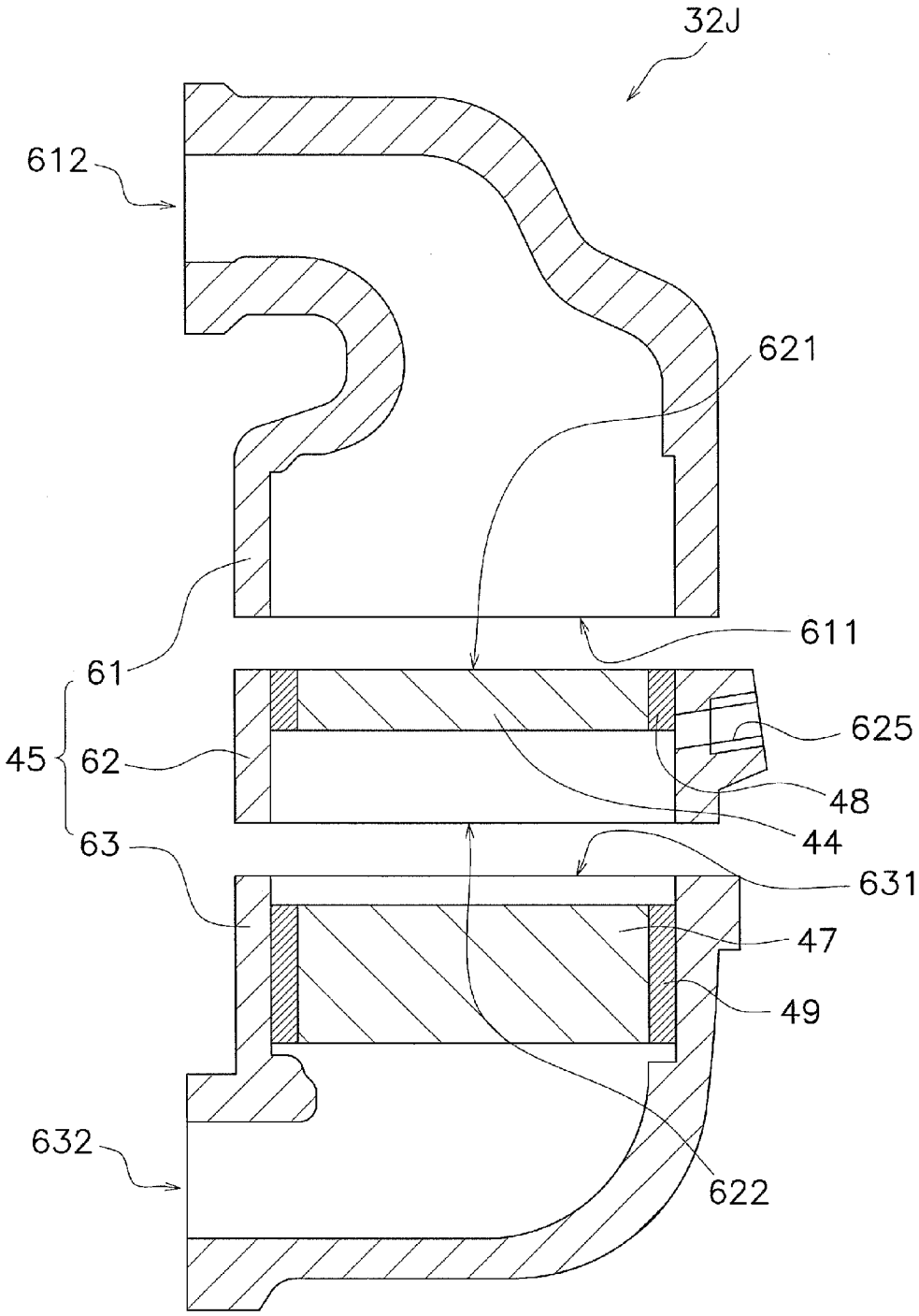
FIG. 19 is an exploded cross-sectional view of a catalyst unit according to a tenth preferred embodiment of the present invention.

FIG. 19 is an exploded cross-sectional view of a catalyst unit 32J of the outboard motor according to the tenth preferred embodiment of the present invention. In the present preferred embodiment, the second pipe section 62 corresponds to the first exhaust passage. The third pipe section 63 and the passage on the downstream side from the third pipe section 63 in the exhaust passage 16 correspond to the second exhaust passage. In other words, the second exhaust passage includes the third pipe section 63, the first lower passage 51, and the fourth passage 38. The first pipe section 61 and the passage on the upstream side from the first pipe section 61 in the exhaust passage 16 correspond to the third exhaust passage. In other words, the third exhaust passage includes the exhaust manifold 31 and the first pipe section 61.

The catalyst member 44 is disposed in the second pipe section 62, as shown in FIG. 19. The catalyst member 44 is disposed on the upstream side from the hole 625 in the second pipe section 62. The configuration of the catalyst unit 32J according to the tenth preferred embodiment is otherwise preferably the same as the configuration of the catalyst unit 32I according to the ninth preferred embodiment.

The catalyst member 44 is passed through the opening 621 of the second pipe section 62 and press-fitted into the second pipe section 62 during assembly of the catalyst unit 32J according to the present preferred embodiment. The first pipe section 61 is thereafter mounted on the second pipe section 62. The water capture member 47 is passed through the opening 631 of the third pipe section 63 and press-fitted into the third pipe section 63. The second pipe section 62 is thereafter mounted on the third pipe section 63. The first pipe section 61 is mounted on the exhaust manifold 31. The third pipe section 63 is mounted on the first lower passage 51. The oxygen sensor 56 is mounted in the hole 625.

In the catalyst unit 32J according to the present preferred embodiment, the hole 625 arranged to receive the oxygen sensor 56 is provided on the downstream side from the catalyst member 44 in the second pipe section 62. The catalyst member 44 is passed through the opening 621 provided at the upstream-side end portion of the second pipe section 62 and press-fitted therein. Accordingly, the catalyst member 44 does not pass through the hole 625 when the catalyst member 44 is press-fitted into the second pipe section 62. Therefore, the first holding mat 48 is prevented from catching on the hole 625 when the catalyst member 44 is press-fitted into the second pipe section 62. Accordingly, the first holding mat 48 is prevented from being damaged. The force for holding the catalyst member 44 can thus be improved.

Figure 20:
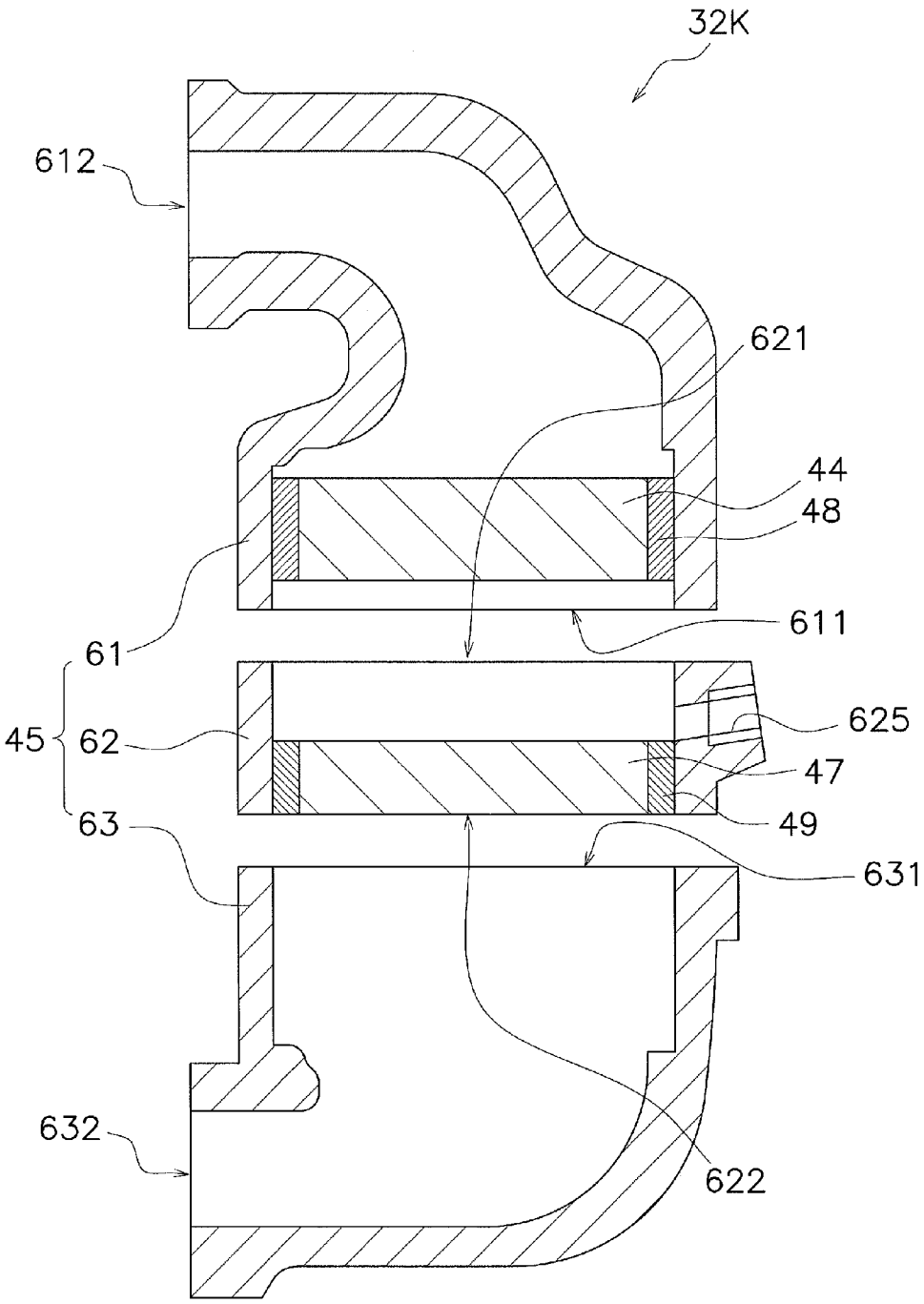
FIG. 20 is an exploded cross-sectional view of a catalyst unit according to an eleventh preferred embodiment of the present invention.

FIG. 20 is an exploded cross-sectional view of a catalyst unit 32K of the outboard motor according to the eleventh preferred embodiment of the present invention. In the present preferred embodiment, the first pipe section 61 and the passage on the upstream side from the first pipe section 61 in the exhaust passage 16 correspond to the first exhaust passage. In other words, the first exhaust passage includes the exhaust manifold 31 and the first pipe section 61. The second pipe section 62 corresponds to the second exhaust passage. The third pipe section 63 and the passage on the downstream side from the third pipe section 63 in the exhaust passage 16 correspond to the third exhaust passage. In other words, the third exhaust passage includes the third pipe section 63, the first lower passage 51, and the fourth passage 38.

The water capture member 47 is disposed inside the second pipe section 62, as shown in FIG. 20. The water capture member 47 is disposed on the downstream side from the hole 625 in the second pipe section 62. The configuration of the catalyst unit 32K according to the eleventh preferred embodiment is otherwise preferably the same as the configuration of the catalyst unit 32I according to the ninth preferred embodiment.

The catalyst member 44 is passed through the opening 611 and press-fitted into the first pipe section 61 during assembly of the catalyst unit 32K. The first pipe section 61 is thereafter mounted on the second pipe section 62. The water capture member 47 is passed through the opening 622 and press-fitted into the second pipe section 62. The second pipe section 62 is thereafter mounted on the third pipe section 63. Also, the first pipe section 61 is mounted on the exhaust manifold 31. The third pipe section 63 is mounted on the first lower passage 51. The oxygen sensor 56 is mounted in the hole 625.

In the catalyst unit 32K according to the present preferred embodiment, the hole 625 arranged to receive the oxygen sensor 56 is provided on the upstream side from the water capture member 47 in the second pipe section 62. The water capture member 47 is passed through the opening 622 provided at the downstream-side end portion of the second pipe section 62. Accordingly, the water capture member 47 does not pass through the hole 625 when the water capture member 47 is press-fitted into the second pipe section 62. Therefore, the second holding mat 49 is prevented from catching on the hole 625 when the water capture member 47 is press-fitted into the second pipe section 62. Accordingly, the second holding mat 49 is prevented from being damaged. The force for holding the water capture member 47 can thus be improved.

Preferred embodiments of the present invention have been described above, but the present invention is not limited to the above-described preferred embodiments and can be modified in a variety of ways within a range that does not depart from the scope of the present invention.

The number of the cylinders is not limited to four. The number of the cylinders may also be three or less. Alternatively, the number of the cylinders may be five or greater.

The exhaust manifold 31 may be a component that is separate from the cylinder head 22. The first passage 33 and the second passage 34 included in the exhaust manifold 31 may be constructed from separate components. The third passage 35 may be constructed solely from the pipe 45 of the catalyst unit 32A without including the above-described first lower passage 51. Alternatively, the third passage 35 may be further constructed from a separate member in addition to the catalyst unit 32A and the first lower passage 51.

The water capture member 47 is not limited to the catalyst carrier and may be any member that has high permeability to gases but low permeability to liquids. A member including perforated metal and/or a mesh, for example, may also be used as the water capture member 47, for example.

The catalyst member 44 may be disposed inside the first exhaust passage using a manufacturing method other than press-fitting. The water capture member 47 may be disposed inside the second exhaust passage using a manufacturing method other than press-fitting. A honeycomb structure that does not include a catalyst may be disposed in place of the catalyst member 44. A honeycomb structure that does not include a catalyst may be disposed in place of the water capture member 47.

The order in which pipe sections are assembled and the oxygen sensors are mounted is not limited to the sequence described above and may be modified within a range that does not interfere with press-fitting the catalyst member 44 or the water capture member 47.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of vertically aligned cylinders;

a propeller shaft driven by a drive force from the engine;

a plurality of exhaust ports connected to the plurality of cylinders;

an exhaust passage connected to the plurality of exhaust ports, the exhaust passage being configured to discharge exhaust to an exterior of the engine, the exhaust passage including a first exhaust passage and a second exhaust passage positioned on a downstream side of the first exhaust passage;

a first honeycomb structure disposed inside the first exhaust passage; and a second honeycomb structure disposed inside the second exhaust passage; wherein the first exhaust passage and the second exhaust passage are separate and independent members that are connected to each other;

a first opening into which the first honeycomb structure can be inserted is provided at an end portion of the first exhaust passage; and a second opening into which the second honeycomb structure can be inserted is provided at an end portion of the second exhaust passage.

2. The outboard motor according to claim 1, wherein the first honeycomb structure and the second honeycomb structure have a same or substantially the same outside diameter.

3. The outboard motor according to claim 1, wherein the first opening and the second opening have a same or substantially the same inside diameter.

4. The outboard motor according to claim 1, wherein the first honeycomb structure is press-fitted inside the first exhaust passage.

5. The outboard motor according to claim 1, wherein the second honeycomb structure is press-fitted inside the second exhaust passage.

6. The outboard motor according to claim 1, wherein the first honeycomb structure includes a catalyst, and the second honeycomb structure does not include a catalyst.

7. The outboard motor according to claim 1, further comprising an engine cover arranged to cover the engine, wherein the first exhaust passage is disposed inside the engine cover.

8. The outboard motor according to claim 1, further comprising an oxygen sensor disposed between the first honeycomb structure and the second honeycomb structure in the exhaust passage.

9. The outboard motor according to claim 8, wherein a recessed portion is provided on an inner surface of the exhaust passage;

the recessed portion is provided along a circumferential direction of the exhaust passage such that the recessed portion has an inner diameter larger than an inner diameter of a non-recessed portion of the exhaust passage, and is disposed between the first honeycomb structure and the second honeycomb structure; and a hole arranged to receive the oxygen sensor is provided in the recessed portion.

10. The outboard motor according to claim 9, wherein the recessed portion is provided in the first exhaust passage.

11. The outboard motor according to claim 10, wherein the recessed portion is large enough to accommodate a press-fitting jig used to press-fit the first honeycomb structure into the first exhaust passage.

12. The outboard motor according to claim 9, wherein the recessed portion is provided in the second exhaust passage.

13. The outboard motor according to claim 12, wherein the recessed portion is large enough to accommodate a press-fitting jig used to press-fit the second honeycomb structure into the second exhaust passage.

14. The outboard motor according to claim 9, wherein the exhaust passage includes a rib protruding from a bottom surface of the recessed portion, and a height of the rib from the bottom surface of the recessed portion is less than a depth of the recessed portion.

15. The outboard motor according to claim 14, wherein the rib is positioned on an upstream side of the hole.

16. The outboard motor according to claim 8, wherein the exhaust passage further includes a third exhaust passage disposed between the first exhaust passage and the second exhaust passage;

the third exhaust passage is a separate and independent member from each of the first exhaust passage and the second exhaust passage; and a hole arranged to receive the oxygen sensor is provided in the third exhaust passage.

17. The outboard motor according to claim 8, wherein a hole arranged to receive the oxygen sensor is provided in an inner surface of the exhaust passage between the first honeycomb structure and the second honeycomb structure; and a mounting section to mount a blocking member to block off the hole when the first honeycomb structure and the second honeycomb structure are inserted is provided on an outer surface of the exhaust passage.

18. The outboard motor according to claim 1, wherein the first opening is provided at a downstream-side end portion of the first exhaust passage;

the second opening is provided at an upstream-side end portion of the second exhaust passage; and the downstream-side end portion of the first exhaust passage is connected to the upstream-side end portion of the second exhaust passage.

19. The outboard motor according to claim 1, wherein the first opening is provided at a downstream-side end portion of the first exhaust passage;

the second opening is provided at an upstream-side end portion of the second exhaust passage;

the exhaust passage further includes a third exhaust passage disposed between the first exhaust passage and the second exhaust passage;

the third exhaust passage is a separate and independent member from each of the first exhaust passage and the second exhaust passage;

the downstream-side end portion of the first exhaust passage is connected to an upstream-side end portion of the third exhaust passage; and the upstream-side end portion of the second exhaust passage is connected to a downstream-side end portion of the third exhaust passage.

20. The outboard motor according to claim 1, further comprising an oxygen sensor disposed in the exhaust passage between the first honeycomb structure and the second honeycomb structure; wherein the exhaust passage further includes a third exhaust passage positioned on an upstream side of the first exhaust passage;

the third exhaust passage is a separate and independent member from the first exhaust passage;

the first opening is provided at an upstream-side end portion of the first exhaust passage; and a hole arranged to receive the oxygen sensor is provided on a downstream side from the first honeycomb structure in the first exhaust passage.

21. The outboard motor according to claim 1, further comprising an oxygen sensor disposed in the exhaust passage between the first honeycomb structure and the second honeycomb structure; wherein the exhaust passage further includes a third exhaust passage positioned on a downstream side of the second passage;

the third exhaust passage is a separate and independent member from the second exhaust passage;

the second opening is provided at the downstream-side end portion of the second exhaust passage; and a hole arranged to receive the oxygen sensor is provided on an upstream side from the second honeycomb structure in the second exhaust passage.

22. The outboard motor according to claim 1, wherein the first exhaust passage includes a plurality of separate and independent members that are connected to each other.

23. The outboard motor according to claim 22, further comprising an engine cover arranged to cover the engine; wherein the first exhaust passage is disposed inside the engine cover;

the first exhaust passage includes an upstream-side portion to direct exhaust from the plurality of exhaust ports upward from below, and a downstream-side portion to direct exhaust from the upstream-side portion downward; and a first honeycomb structure is disposed in the downstream-side portion.

24. The outboard motor according to claim 1, wherein the first exhaust passage includes a plurality of separate and independent members that are connected to each other.

25. The outboard motor according to claim 24, further comprising an engine cover arranged to cover the engine; wherein the second exhaust passage includes an upstream-side portion to direct exhaust from the first exhaust passage inside the engine cover downward from above, and a downstream-side portion to direct exhaust from the upstream-side portion to the exterior of the engine cover; and a second honeycomb structure is disposed in the upstream-side portion.

* * * * *